US008433213B2

(12) United States Patent
Hozumi et al.

(10) Patent No.: US 8,433,213 B2
(45) Date of Patent: Apr. 30, 2013

(54) CLEANING DEVICE AND IMAGE FORMING APPARATUS

(75) Inventors: Yoshiki Hozumi, Kanagawa (JP); Kenji Sugiura, Kanagawa (JP); Osamu Naruse, Kanagawa (JP); Naomi Sugimoto, Kanagawa (JP); Hisashi Kikuchi, Kanagawa (JP); Yuu Sakakibara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 273 days.

(21) Appl. No.: 13/046,884

(22) Filed: Mar. 14, 2011

(65) Prior Publication Data

US 2011/0229187 A1 Sep. 22, 2011

(30) Foreign Application Priority Data

Mar. 18, 2010 (JP) ..... 2010-063113

(51) Int. Cl.
*G03G 21/10* (2006.01)

(52) U.S. Cl.
USPC ..... 399/71; 399/101; 399/354

(58) Field of Classification Search ..... 399/71
See application file for complete search history.

(56) References Cited

U.S. PATENT DOCUMENTS

| | | | | |
|---|---|---|---|---|
| 5,526,100 | A | 6/1996 | Misago et al. | |
| 5,592,267 | A | 1/1997 | Misago et al. | |
| 6,799,012 | B2 | 9/2004 | Shakuto et al. | |
| 6,987,944 | B2 | 1/2006 | Shakuto et al. | |
| 7,062,212 | B2 | 6/2006 | Naruse et al. | |
| 7,103,301 | B2 | 9/2006 | Watanabe et al. | |
| 7,123,872 | B2 | 10/2006 | Shakuto et al. | |
| 7,184,699 | B2 | 2/2007 | Naruse et al. | |
| 7,209,699 | B2 | 4/2007 | Yamaguchi et al. | |
| 7,369,807 | B2 | 5/2008 | Naruse et al. | |
| 7,376,380 | B2 | 5/2008 | Koike et al. | |
| 7,415,236 | B2 | 8/2008 | Nakano et al. | |
| 7,415,238 | B2 | 8/2008 | Watanabe et al. | |
| 7,433,626 | B2 * | 10/2008 | Takeuchi | 399/101 |
| 7,496,324 | B2 | 2/2009 | Sugiura et al. | |
| 7,505,728 | B2 | 3/2009 | Yamaguchi et al. | |
| 7,603,071 | B2 | 10/2009 | Sugiura et al. | |
| 7,610,008 | B2 | 10/2009 | Watanabe et al. | |
| 7,620,357 | B2 | 11/2009 | Shakuto et al. | |
| 8,041,281 | B2 * | 10/2011 | Sugimoto et al. | 399/354 |
| 8,045,881 | B2 * | 10/2011 | Sano et al. | 399/101 |
| 8,185,011 | B2 * | 5/2012 | Shibuya et al. | 399/101 |
| 8,280,295 | B2 * | 10/2012 | Naruse et al. | 399/353 |
| 2008/0286020 | A1 | 11/2008 | Watanabe et al. | |

(Continued)

FOREIGN PATENT DOCUMENTS

| | | |
|---|---|---|
| JP | 2002-202702 | 7/2002 |
| JP | 2007-25173 | 2/2007 |

*Primary Examiner* — Walter L Lindsay, Jr.
*Assistant Examiner* — Philip Marcus T Fadul
(74) *Attorney, Agent, or Firm* — Oblon, Spivak, McClelland, Maier & Neustadt, L.L.P.

(57) ABSTRACT

A cleaning device includes a normally charged toner cleaning unit, a reversely charged toner cleaning unit, and a pre-cleaning unit. The normally charged toner cleaning unit has a normally charged toner cleaning member, a normally charged toner recovery member, and a normally charged toner scraping member. The reversely charged toner cleaning unit has a reversely charged toner cleaning member, a reversely charged toner recovery member, and a reversely charged toner scraping member. The pre-cleaning unit has a pre-cleaning member, a pre-recovery member, and a pre-scraping member.

12 Claims, 7 Drawing Sheets

U.S. PATENT DOCUMENTS

2009/0176669 A1 7/2009 Sugiura et al.
2010/0008706 A1* 1/2010 Sugiura et al. ..... 399/350
2011/0085834 A1 4/2011 Naruse et al.
2011/0103822 A1 5/2011 Sugiura et al.
2011/0158677 A1* 6/2011 Kikuchi et al. ..... 399/101
2011/0229234 A1 9/2011 Hozumi et al.

* cited by examiner

CLEANING DEVICE AND IMAGE FORMING APPARATUS

CROSS-REFERENCE TO RELATED APPLICATIONS

The present application claims priority to and incorporates by reference the entire contents of Japanese Patent Application No. 2010-063113 filed in Japan on Mar. 18, 2010.

BACKGROUND OF THE INVENTION

1. Field of the Invention

The present invention relates to a cleaning device and an image forming apparatus.

2. Description of the Related Art

As a cleaning device employed in an image forming apparatus such as a copying machine, a facsimile, and a printer, known is a blade cleaning method for removing a toner on an image carrier by pressing a cleaning blade made of an elastic member against the periphery of the image carrier that is a body to be cleaned and by scraping the toner off. The blade cleaning method is widely used because of its simple implementation and stable performance.

In recent years, there has been a growing demand for the improvement of image quality, and in response to the demand, the formation of toners having a smaller particle size and being more spherical proceeds. Higher precision, higher resolution, and higher definition images can be obtained by reducing the particle size of a toner, and the developing performance and transfer performance can be improved by making the toner more spherical.

However, when a toner that has a smaller particle size and is made more spherical is used, it becomes difficult to perform favorable cleaning by a typical cleaning blade method. The reason of this is described below. That is, a cleaning blade removes a toner while rubbing the surface of an image carrier, which causes a so-called stick slip caused by the deformation of the edge of the cleaning blade due to frictional resistance against the image carrier. Therefore, a minute space is formed between the image carrier and the cleaning blade. A toner having a smaller particle size is prone to enter this space, and the entering toner being more spherical in shape is prone to roll in the space because angular moment is generated in the toner. As a result, the toner that has a smaller particle size and is made more spherical is prone to push the cleaning blade up and to get into a space between the cleaning blade and the image carrier.

The use of the toner that has a smaller particle size and is made more spherical is considered to increase the pressing force (linear pressure) of the cleaning blade against the image carrier to inhibit the toner from getting inside. However, when the pressing force is increased to impose high loads, the abrasion of the image carrier and the cleaning blade proceeds to severely shorten their service life. Devices are required to have long service life in recent years, and therefore, such disadvantage associated with durability needs to be avoided.

When an electrostatic cleaning method is employed as with cleaning devices disclosed in Japanese Patent Application Laid-open No. 2002-202702 and Japanese Patent Application Laid-open No. 2007-25173, a toner produced by a polymerization method can also be favorably removed. Even when the charged polarity of the toner to be removed is both positive and negative, the toner can be favorably removed. The cleaning device disclosed in Japanese Patent Application Laid-open No. 2002-202702 includes a conductive blade that comes in contact with an image carrier and is applied with a voltage having a reversed polarity relative to the polarity of a cleaning brush, as a polarity control unit that aligns the charged polarity of the toner. The conductive blade is provided upstream of the cleaning brush as a cleaning member. In the cleaning device disclosed in Japanese Patent Application Laid-open No. 2002-202702, while a toner left untransferred passes through a position (blade contact position) where the conductive blade makes contact with the image carrier, charges are injected to the toner from the conductive blade. In such a manner, for example, the charged polarity of the toner is aligned with the same polarity (typically, the normally charged polarity of the toner) as that of the conductive blade. Accordingly, the charged polarity of the toner that passes through the blade contact position and that reaches a position (roller contact position) where the cleaning brush comes in contact with the image carrier is one of the polarities (the same polarity as that of the conductive blade). Therefore, even when a toner having a positive polarity and a toner having a negative polarity are mixed before cleaning, the cleaning brush can electrostatically recover the toners.

The cleaning device disclosed in Japanese Patent Application Laid-open No. 2007-25173 includes a first cleaning brush applied with a voltage having a reversed polarity (positive polarity) relative to a normally charged polarity of a toner, and a second cleaning brush applied with a voltage having the same polarity as the normally charged polarity of the toner at the downstream of the first cleaning brush. The toner having a normally charged polarity (negative polarity) on an image carrier is electrostatically adsorbed to the first cleaning brush serving as a normally charged toner cleaning member and is removed from the image carrier. The toner having a reversed polarity (positive polarity) relative to the normally charged polarity on the image carrier is electrostatically adsorbed to the second cleaning brush serving as a reversely charged toner cleaning member and is removed from the image carrier. Accordingly, both the toner having a positive polarity and the toner having a negative polarity can be removed from the image carrier.

However, when an untransferred toner image, such as a toner pattern, in which a large amount of toner adheres to the image carrier enters a cleaning device having such structure disclosed in Japanese Patent Application Laid-open No. 2002-202702 and Japanese Patent Application Laid-open No. 2007-25173, the toner cannot be favorably removed from the image carrier. This may cause cleaning failure.

For this reason, the applicant of the present invention has developed the following cleaning device described in Japanese Patent Application No. 2009-293120. Specifically, the cleaning device includes a pre-cleaning brush that roughly removes a toner having a normally charged polarity. The pre-cleaning brush is provided at a position upstream of the polarity control unit in the movement direction of the surface of the image carrier in the case for the cleaning device disclosed in Japanese Patent Application Laid-open No. 2002-202702. The pre-cleaning brush is provided at a position upstream of the first cleaning brush in the movement direction of the surface of the image carrier in the case for the cleaning device disclosed in Japanese Patent Application Laid-open No. 2007-25173. The pre-cleaning brush is provided in such a manner. Thus, when an untransferred toner image enters the cleaning device, the pre-cleaning brush roughly removes the toner having a normally charged polarity that is dominant in the toner constituting the untransferred toner image. This reduces the toner amount entering a polarity unit and a cleaning brush that are provided downstream of the pre-cleaning brush. Therefore, the structure downstream of the pre-cleaning brush in the movement direction of the image carrier can favorably remove the remaining toner that remains unremoved by the pre-cleaning brush incorporated in the structures in the cleaning devices disclosed in Japanese Patent Application Laid-open No. 2002-202702 and Japanese Patent Application Laid-open No. 2007-25173.

The cleaning device developed by the applicant of the present invention includes a pre-cleaning unit including a pre-cleaning brush and a cleaning unit including a cleaning brush arranged downstream of the pre-cleaning unit in the movement direction of the image carrier. The pre-cleaning unit includes, besides the pre-cleaning brush, a pre-recovery roller as a pre-recovery member that recovers a toner adhering to the pre-cleaning brush, and a pre-scraping blade as a pre-scraping member that makes contact with the surface of the pre-recovery roller and scrapes off the toner remaining on the pre-recovery roller from the pre-recovery roller. The cleaning unit at the downstream also includes, besides the cleaning brush, a pre-recovery roller as a recovery member that recovers the toner adhering to the cleaning brush, and a scraping blade as a scraping member that makes contact with the surface of the recovery roller and scrapes off the toner remaining on the recovery roller from the recovery roller.

In the cleaning device developed by the applicant of the present invention, the toner is adversely fixed to the scraping blade of the cleaning unit at the downstream. When the toner is thus fixed to the scraping blade of the cleaning unit at the downstream, the scraping ability decreases to make the toner remain on the recovery roller. When the toner remains on the recovery roller, the toner on the cleaning brush is unlikely to adhere to the recovery roller, which reduces the toner recovery ability of the recovery roller. When the toner recovery ability of the recovery roller decreases, the toner remaining on the cleaning brush increases to reduce the toner amount that newly adheres to the cleaning brush. As a result, the cleaning ability of the cleaning unit at the downstream decreases, which may cause cleaning failure.

As a result of assiduous research intended to overcome the toner being fixed on the scraping blade of the cleaning unit at the downstream, the inventors of the present invention have found out the followings. That is, a certain amount of a toner enters a contact portion between the scraping blade and the recovery roller, and the entering toner serves as a lubricant to suppress the friction between the scraping blade and the recovery roller. However, in the cleaning device as mentioned above, the pre-cleaning unit removes a large amount of the toner on the image carrier, and therefore, the amount of the toner to be removed by the cleaning unit provided downstream of the pre-cleaning unit is small. The toner amount entering the contact portion between the scraping blade and the recovery roller of the cleaning unit at the downstream is small, and therefore, the toner cannot sufficiently function as a lubricant. Thus, the contact portion of the scraping member generates heat due to the friction between the scraping blade and the recovery roller. As a result, the toner entering the contact portion between the scraping blade and the recovery roller is melted by the heat of the scraping blade caused by the heat generation of the scraping blade and is fixed to the scraping blade.

SUMMARY OF THE INVENTION

It is an object of the present invention to at least partially solve the problems in the conventional technology.

According to one aspect of the present invention, there is provided a cleaning device that includes a normally charged toner cleaning unit including a normally charged toner cleaning member that is applied with a voltage having a reversed polarity relative to a normally charged polarity of a toner and electrostatically removes the toner having the normally charged polarity on a body to be cleaned, a normally charged toner recovery member that makes the toner on the normally charged toner cleaning member electrostatically move to a surface of the normally charged toner recovery member and recovers the toner, and a normally charged toner scraping member that rubs the surface of the normally charged toner recovery member and scrapes off the toner on the normally charged toner recovery member; a reversely charged toner cleaning unit including a reversely charged toner cleaning member that makes contact with the body to be cleaned while rotating, is applied with a voltage having a polarity same as the normally charged polarity of the toner, and electrostatically removes the toner having a reversed polarity relative to the normally charged polarity on the body to be cleaned, a reversely charged toner recovery member that makes the toner on the reversely charged toner cleaning member electrostatically move to a surface of the reversely charged toner recovery member and recovers the toner, and a reversely charged toner scraping member that rubs the surface of the reversely charged toner recovery member and scrapes off the toner on the reversely charged toner recovery member; and a pre-cleaning unit including a pre-cleaning member that is arranged upstream of the normally charged toner cleaning member and the reversely charged toner cleaning member in a movement direction of a surface of the body to be cleaned, makes contact with the body to be cleaned while rotating, is applied with a voltage having a reversed polarity relative to the normally charged polarity of the toner, and electrostatically removes the toner having the normally charged polarity, a pre-recovery member that makes the toner on the pre-cleaning member electrostatically move to a surface of the pre-recovery member and recovers the toner, and a pre-scraping member that rubs the surface of the pre-recovery member and scrapes off the toner on the pre-recovery member, wherein a toner recovery ability of the normally charged toner scraping member from the normally charged toner recovery member and a toner recovery ability of the reversely charged toner scraping member from the reversely charged toner recovery member are set to be smaller than a toner recovery ability of the pre-scraping member from the pre-recovery member.

According to another aspect of the present invention, there is provided an image forming apparatus that forms an image on a recording member by eventually transferring a toner image formed on an image carrier from the image carrier to the recording member, wherein the cleaning device described just above is used as a cleaning device for cleaning a toner left untransferred remaining on the image carrier after the transferring.

According to still another aspect of the present invention, there is provided a cleaning device that includes a polarity control unit that controls a charged polarity of a toner on a body to be cleaned; a cleaning unit including a cleaning member that is arranged downstream of the polarity control unit in a movement direction of a surface of the body to be cleaned, is applied with a voltage having a reversed polarity relative to a charged polarity of the toner controlled by the polarity control unit, and electrostatically removes the toner, a recovery member that makes the toner on the cleaning member electrostatically move to a surface of the recovery member and recovers the toner, and a scraping member that rubs the surface of the recovery member and scrapes off the toner on the recovery member; and a pre-cleaning unit including a pre-cleaning member that is arranged upstream of the polarity control unit in the movement direction of the surface of the body to be cleaned, is applied with a voltage having a reversed polarity relative to a normally charged polarity of the toner, and electrostatically removes the toner having the normally charged polarity, a pre-recovery member that makes the toner on the pre-cleaning member electrostatically move to a surface of the pre-recovery member and recovers the toner, and a pre-scraping member that rubs the surface of the pre-recovery member and scrapes off the toner on the pre-recovery member, wherein a toner recovery ability of the scraping member from the recovery member is set to be smaller than a toner recovery ability of the pre-scraping member from the pre-recovery member.

According to still another aspect of the present invention, there is provided an image forming apparatus that forms an image on a recording member by eventually transferring a toner image formed on an image carrier from the image carrier to the recording member, wherein the cleaning device just described above is used as a cleaning device for cleaning a toner left untransferred remaining on the image carrier after the transferring.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
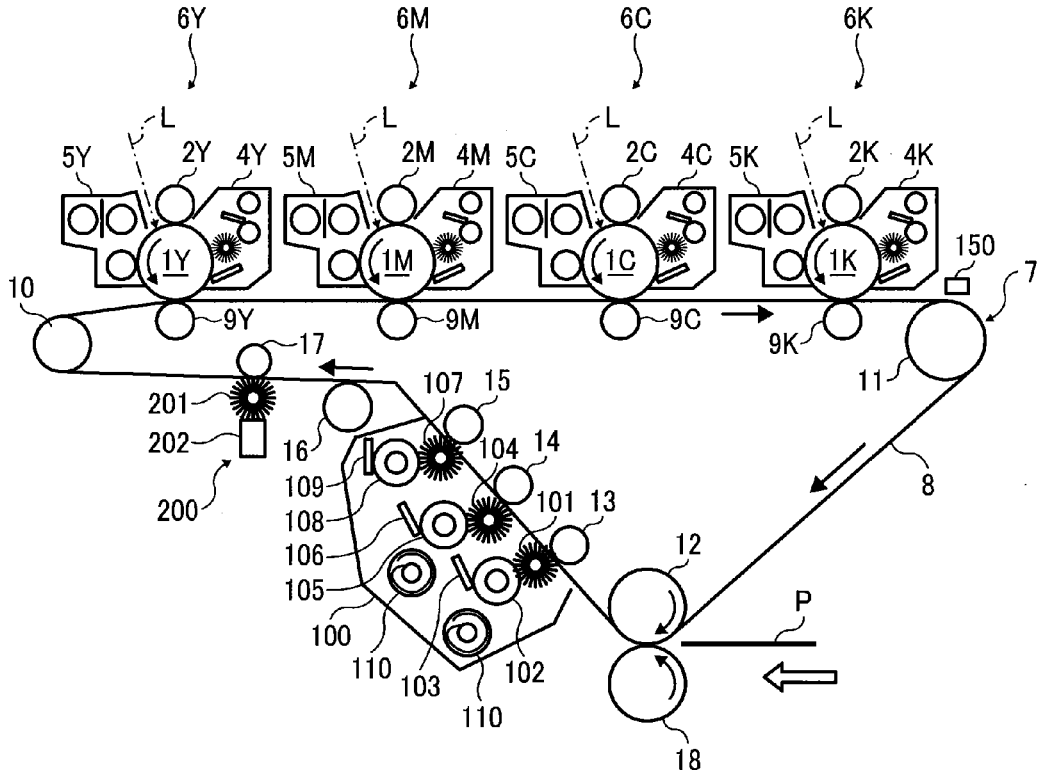
FIG. 1 is a schematic of a relevant portion of a printer according to an embodiment of the present invention.

A so-called tandem intermediate transfer printer (hereinafter simply referred to as a printer) is described below as an embodiment of an image forming apparatus according to the present invention. A basic structure of the printer of the present embodiment is described. FIG. 1 is a schematic of a relevant portion of the printer. The printer includes four process units 6Y, M, C, and K for producing toner images of yellow, magenta, cyan, and black (hereinafter expressed as Y, M, C, and K, respectively). The four process units 6Y, M, C, and K include respective cylindrical-shaped photosensitive elements 1Y, M, C, and K. The process units 6Y, M, C, and K include, respectively, around the photosensitive elements 1Y, M, C, and K, charging units 2Y, M, C, and K, developing units 5Y, C, M, and K, drum cleaning devices 4Y, M, C, and K, and neutralization apparatuses (not illustrated). The process units 6Y, M, C, and K employ Y, M, C, and K toners having different colors from each other, but other than that, has similar structures to each other. An optical writing unit (not illustrated) is provided above the process units 6Y, M, C, and K for irradiating the surfaces of the photosensitive elements 1Y, M, C, and K with laser light L to write electrostatic latent images.

A transfer unit 7 is provided below the process units 6Y, M, C, and K as a belt apparatus including an endless intermediate transfer belt 8 as a belt member. The transfer unit 7 includes, besides the intermediate transfer belt 8, a plurality of stretching rollers provided inside the loop of the belt, and a secondary transfer roller 18, a tension roller 16, a belt cleaning device 100, and a lubricant application apparatus 200 that are provided outside the loop.

Four primary transfer rollers 9Y, M, C, and K, a driven roller 10, a driving roller 11, a secondary transfer counter roller 12, three cleaning counter rollers 13, 14, and 15, and an application brush counter roller 17 are provided inside of the loop of the intermediate transfer belt 8. The intermediate transfer belt 8 is looped around a portion of the peripheral surface of any of these rollers so as to be stretched, and thus, the rollers function as stretching rollers. The cleaning counter rollers 13, 14, and 15 do not necessarily function to impart a certain tension as a necessary condition, and may be driven and rotated following the rotation of the intermediate transfer belt 8. The intermediate transfer belt 8 endlessly moves in a clockwise direction as viewed in FIG. 1 following the rotation of the driving roller 11 driven in rotation in a clockwise direction as viewed in FIG. 1 by a driving unit (not illustrated).

The intermediate transfer belt 8 is nipped between the four primary transfer rollers 9Y, M, C, and K provided inside the belt loop and the photosensitive elements 1Y, M, C, and K. Therefore, primary transfer nips for Y, M, C, and K are formed at positions where the front surface of the intermediate transfer belt 8 comes in contact with the photosensitive elements 1Y, M, C, and K. A power supply (not illustrated) applies primary transfer bias having a reversed polarity relative to the polarity of a toner to each of the primary transfer rollers 9Y, M, C, and K.

The intermediate transfer belt 8 is nipped between the secondary transfer counter roller 12 provided inside the belt loop and the secondary transfer roller 18 provided outside the belt loop. Thus, a secondary transfer nip is formed at a position where the front surface of the intermediate transfer belt 8 comes in contact with the secondary transfer roller 18. A power supply (not illustrated) applies secondary transfer bias having a reversed polarity relative to the polarity of the toner to the secondary transfer roller 18. A paper conveying belt may be looped over the secondary transfer roller, several support rollers, and a driving roller so that the intermediate transfer belt 8 and the paper conveying belt may be nipped between the secondary transfer roller 18 and the secondary transfer counter roller 12.

The intermediate transfer belt 8 is nipped between the cleaning counter rollers 13, 14, and 15 provided inside the belt loop and cleaning brush rollers 101, 104, and 107 of the belt cleaning device 100 provided outside the belt loop. Therefore, cleaning nips are formed at positions where the front surface of the intermediate transfer belt 8 comes in contact with the cleaning brush rollers 101, 104, and 107. The belt cleaning device 100 is integrally replicable with the intermediate transfer belt 8. However, when the setting of service life of the belt cleaning device 100 differs from that of the intermediate transfer belt 8, the belt cleaning device 100 and the intermediate transfer belt 8 may be independently detachable from the printer main body. The detail of the belt cleaning device 100 is described later.

The printer of the present embodiment includes a paper cassette that houses a recording sheet P and a paper feeding unit (not illustrated) including a paper feeding roller that feeds the recording sheet P from the paper cassette to a feed path. The printer also includes a pair of registration rollers (not illustrated) that receives the recording sheet fed from the paper feeding unit and that feeds the recording sheet into the secondary transfer nip at a predetermined timing on the right of the secondary transfer nip as viewed in FIG. 1. The printer also includes a fixing device (not illustrated) that receives the recording sheet P fed from the secondary transfer nip and that performs a fixing process of a toner image onto the recording sheet P on the left of the secondary transfer nip as viewed in FIG. 1. Moreover, the printer includes toner replacement devices for Y, M, C, and K (not illustrated) that supply the Y, M, C, and, K toners to the developing units 5Y, M, C, and K, as needed.

In recent years, in addition to ordinary paper that has been widely used as recording sheets, special paper whose surface is designed to have projections and depressions and special recording sheets used for thermal transfer such as iron-printing are increasingly used. The use of such special paper is apt to cause transfer failure when the toner image formed by superimposing color toners on the intermediate transfer belt 8 is secondary transferred onto the paper as compared with the use of conventional ordinary paper. Therefore, in the printer of the present embodiment, the intermediate transfer belt 8 includes an elastic layer having low hardness so that the belt can be deformed relative to a toner layer and a recording sheet having low smoothness at the transfer nip. The intermediate transfer belt 8 includes the elastic layer having low hardness so as to have elasticity, and thus, the surface of the intermediate transfer belt 8 can be deformed following the local projections and depressions. Accordingly, favorable adhesion can be obtained without excessively increasing transfer pressure to the toner layer, and a transfer image excellent in uniformity that has no transfer omission of letters and that has no transfer unevenness even to sheets having low smoothness or other sheets.

In the printer of the present embodiment, the intermediate transfer belt 8 includes at least a base layer, an elastic layer, and a coating layer as the surface.

Examples of materials used for the elastic layer of the intermediate transfer belt 8 include elastic members such as elastic rubber materials and elastomers. Specific examples of the materials available include one or more types selected from the group consisting of butyl rubber, fluorine rubbers, acrylic rubbers, ethylene-propylene rubber (EPDM), nitrile rubber (NBR), acrylonitrile-butadiene-styrene rubber, natural rubber, isoprene rubber, styrene-butadiene rubber, butadiene rubber, urethane rubbers, syndiotactic 1,2-polybutadiene, epichlorohydrin rubbers, polysulfide rubbers, polynorbornene rubber, thermoplastic elastomers (such as polystyrene-based, polyolefin-based, polyvinyl chloride-based, polyurethane-based, polyamide-based, polyurea-based, polyester-based, and fluorine resin-based elastomers), etc. However, the materials are not limited to them.

The thickness of the elastic layer depends on the hardness and the layered structure but is preferably, in the range of 0.07 millimeter to 0.5 millimeter and more preferably, in the range of 0.25 millimeter to 0.5 millimeter. When the thickness of the intermediate transfer belt 8 is thin and is equal to or less than 0.07 millimeter, the pressure against the toner on the intermediate transfer belt 8 at the secondary transfer nip increases to easily cause transfer omission to lower the transfer rate of the toner.

The hardness of the elastic layer is preferably 10 degrees≦HS≦65 degrees (JIS-A). The optimal hardness varies depending on the layer thickness of the intermediate transfer belt 8, but transfer omission is easily caused when the hardness is less than 10 degrees (JIS-A). In contrast, when the hardness is more than 65 degrees (JIS-A), it becomes difficult to stretch the intermediate transfer belt 8 by rollers. Moreover, the belt has little durability because the belt is extended due to a long term stretching, and as a result, the replacement is required at an early stage.

The base layer of the intermediate transfer belt 8 includes resins with low extensibility. Specific examples of materials used for the base layer include one or more types selected from the group consisting of polycarbonates, fluorine resins (such as ethylene tetrafluoroethylene (ETFE) and polyvinylidene fluoride (PVDF)), polystyrene, chloropolystyrene, poly-α-methylstyrene, styrene-butadiene copolymers, styrene-vinyl chloride copolymers, styrene-vinyl acetate copolymers, styrene-maleic acid copolymers, styrene-acrylic acid ester copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylic acid ester copolymers (such as styrene-methyl methacrylate copolymers, styrene-ethyl methacrylate copolymers, and styrene-phenyl methacrylate copolymers), styrene-methyl-α-chloroacrylate copolymers, styrene-based resins such as styrene-acrylonitrile-acrylic acid ester copolymers (monopolymers or copolymers that contain styrene or styrene substitution products), methyl methacrylate resins, butyl methacrylate resins, ethyl acrylate resins, butyl acrylate resins, modified acrylic resins (such as silicone modified acrylic resins, vinyl chloride resin-modified acrylic resins, and acrylic urethane resins), vinyl chloride resins, styrene-vinyl acetate copolymers, vinyl chloride-vinyl acetate resins, rosin-modified maleic acid resins, phenolic resins, epoxy resins, polyester resins, polyester polyurethane resins, polyethylene, polypropylene, polybutadiene, polyvinylidene chloride, ionomer resins, polyurethane resins, silicone resins, ketone resins, ethylene-ethyl acrylate copolymers, xylene resins, polyvinyl butyral resins, polyamide resins, modified polyphenylene oxide resins, etc. However, the materials are not limited to them.

A core body layer made of materials such as sailcloth may be provided between the base layer and the elastic layer in order to prevent the extension of the elastic layer made of rubber materials with high extensibility. Examples of materials that are used for the core body layer and prevent the extension include one or more types selected from the group consisting of natural fibers such as cotton and silk, synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers, inorganic fibers such as carbon fibers and glass fibers, and metal fibers such as iron fibers and copper fibers. The fibers may be configured as threads or textiles. However, the materials are not limited to them. The threads may be formed in any twisted forms such as yarns formed by twisting one or a plurality of filaments, half twisted yarns, ply yarns, two-fold yarns, or other yarns. The threads may be formed by, for example, blending fiber materials selected from the material group described above. The threads can also be properly processed to have electric conduction. As the textiles, textiles woven in any manner such as stockinette stitch are available, intertextures are also available, and the textiles can also be processed to have electric conduction.

The coating layer at the surface of the intermediate transfer belt 8 is formed for coating the surface of the elastic layer and is formed of a layer having high smoothness. Materials used for the coating layer is not particularly limited. However, typically used are materials with which the adhesive force of the toner to the surface of the intermediate transfer belt 8 decreases to improve secondary transfer performance. Examples of the materials available include one or more types of polyurethanes, polyesters, epoxy resins, etc., or materials for reducing surface energy and increasing lubricity, such as one or more types of particles of fluorine resins, fluorine compounds, carbon fluorides, titanium oxides, silicon carbides, etc., or materials in which the particles whose diameters are modified as needed are dispersed. Moreover, materials that are heat-treated to be formed into a fluorine layer at the surface of the belt to reduce the surface energy, such as fluorine rubber materials, are also available.

The base layer, the elastic layer, or the coating layer can employ the following materials as needed in order to adjust the resistance. Examples of the materials include carbon black, graphite, powder of metals such as aluminum and nickel, and conductive metal oxides such as tin oxides, titanium oxides, antimony oxides, indium oxides, potassium titanates, antimony oxide-tin oxide composite oxide (ATO) and indium oxide-tin oxide composite oxide (ITO). The conductive metal oxides may be coated with insulating fine particles of barium sulfate, magnesium silicate, calcium carbonate, or the like. However, the materials are not limited to them.

The lubricant application apparatus 200 applies a lubricant to the surface of the intermediate transfer belt 8 in order to protect the surface of the belt. The lubricant application apparatus 200 includes a solid lubricant 202 such as a block of zinc stearate and an application brush roller 201 as an application member that makes contact with the solid lubricant, that rotates and scrapes the solid lubricant off to produce lubricant powder, and that applies the lubricant powder to the surface of the intermediate transfer belt 8.

When image information is transmitted from a personal computer or other apparatuses, the printer of the present embodiment makes the driving roller 11 drive in rotation to endlessly move the intermediate transfer belt 8. The stretching rollers except for the driving roller 11 are driven in rotation by the belt. At the same time, the photosensitive elements 1Y, M, C, and K of the process units 6Y, M, C, and K are driven in rotation. The charging units 2Y, M, C, and K uniformly charge the surfaces of the photosensitive elements 1Y, M, C, and K. The charged surfaces are irradiated with the laser light L, and thus, electrostatic latent images are formed. The developing units 5Y, M, C, and K develop the electrostatic latent images formed on the surfaces of the photosensitive elements 1Y, M, C, and K to form Y, M, C, and K toner images on the photosensitive elements 1Y, M, C, and K. The Y, M, C, and K toner images are primary transferred so as to be superimposed on the front surface of the intermediate transfer belt 8 at the primary transfer nips for Y, M, C, and K described above. In such a manner, a four color superimposed toner image is formed on the front surface of the intermediate transfer belt 8.

Meanwhile, in the paper feeding unit, a paper feeding roller 27 feeds the recording sheet P from the paper cassette one by one, and the recording sheet P is conveyed to the pair of registration rollers. The recording sheet P is fed into the secondary transfer nip by driving the pair of registration rollers in synchronization with the four color superimposed toner image on the intermediate transfer belt 8, and thus, the four color superimposed toner image on the belt is secondary transferred to the recording sheet P at a time. In such a manner, an image in full color is formed on the surface of the recording sheet P. The recording sheet P after the image formation in full color is conveyed from the secondary transfer nip to the fixing device to perform a fixing process on the toner image.

The drum cleaning devices 4Y, M, C, and K perform a cleaning process for the toner left untransferred on the photosensitive elements 1Y, M, C, and K after the Y, M, C, and K toner images are primary transferred to the intermediate transfer belt 8. Subsequently, the photosensitive elements 1Y, M, C, and K are neutralized by a neutralization lamp (not illustrated) and then are uniformly charged by the charging units 2Y, M, C, and K to be prepared for the subsequent image formation. The belt cleaning device 100 performs a cleaning process for the toner left untransferred on the intermediate transfer belt 8 after the images are primary transferred to the recording sheet P.

Figure 2:
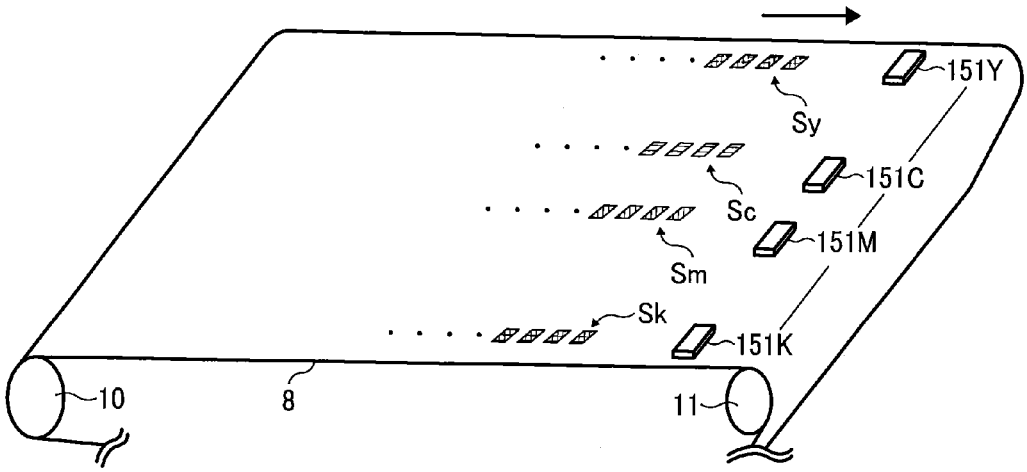
FIG. 2 is an enlarged schematic near an intermediate transfer belt for illustrating tone patterns and optical sensors.

An optical sensor unit 150 is provided on the right of the process unit 6K for K as viewed in FIG. 1 so as to oppose the front surface of the intermediate transfer belt 8 in a predetermined space. As illustrated in FIG. 2, the optical sensor unit 150 includes a Y optical sensor 151Y, a C optical sensor 151C, an M optical sensor 151M, and a K optical sensor 151K that align in a width direction of the intermediate transfer belt 8. Any of these sensors are reflective photo-sensors. In the sensors, the light emitted from light-emitting elements (not illustrated) is reflected on the front surface of the intermediate transfer belt 8 and the toner images on the belt, and light-receiving elements (not illustrated) receive the reflected light and detect the reflected light quantity. A control unit (not illustrated) can detect the toner images on the intermediate transfer belt 8 and detect the image densities of the images (toner adhering quantity per unit area) based on the output voltage value of these sensors.

The printer of the present embodiment performs image density control for optimizing the image density of each color every time the power is tuned on or a predetermined number of sheets are printed.

As illustrated in FIG. 2, in the image density control, tone patterns Sk, Sm, Sc, and Sy in each color are automatically formed at positions opposing respective optical sensors 151Y, M, C, and K on the intermediate transfer belt 8. The tone patterns in each color are formed into ten toner patches whose image densities are different from each other and each of which has an area of 2 centimeters×2 centimeters. When the tone patterns Sk, Sm, Sc, and Sy in each color are produced, the charge potentials of the photosensitive elements 1Y, M, C, and K are not uniform like the uniform drum charge potentials during printing process and are gradually increased. A plurality of electrostatic latent images of the patches for forming tone pattern images are formed on the photosensitive elements 1Y, M, C, and K by being scanned with laser light and are developed by the developing units 5Y, M, C, and K for Y, M, C, and K. During this development, developing bias values applied to the developing rollers for Y, M, C, and K are gradually increased. After such development, Y, M, C, and K tone pattern images are formed on the photosensitive elements 1Y, M, C, and K. The images are primary transferred so as to be aligned in a main-scanning direction of the intermediate transfer belt 8 at predetermined intervals. At this time, the toner adhering quantity of the toner patches of the tone patterns in each color is about 0.1 mg/cm$^2$ in minimum and about 0.55 mg/cm$^2$ in maximum, and the measurement result of toner Q/d distribution is almost aligned with the normally charged polarity.

The toner patterns (Sk, Sm, Sc, and Sy) formed on the intermediate transfer belt 8 pass through the positions opposing the optical sensors 151 following the endless movement of the intermediate transfer belt 8. At this time, each of the optical sensors 151 receives light with the quantity corresponding to the toner adhering quantity per unit area of the toner patch of each of the tone patterns.

The adhering quantity of each toner patch of the toner patterns in each color is calculated from the output voltage of the optical sensor 151 when the toner patches in each color are detected and from an adhering quantity conversion algorithm, and an image forming condition is adjusted based on the calculated adhering quantity. Specifically, a function ($y=ax+b$) indicating a rectilinear graph of the detection result of the toner adhering quantity of the toner patches and the development potentials when each of the toner patches is formed is calculated using regression analysis based on the detection result and the development potentials. The desired value of the image density is previously assigned to this function to calculate a proper developing bias value, and thus, the developing bias values for Y, M, C, and K are identified.

The memory stores therein an image forming condition data table in which several dozen different developing bias values are associated with proper drum charge potentials individually corresponding to each patches. For each of the process units 6Y, M, C, and K, a developing bias value that is closest to the identified developing bias value is selected from the image forming condition table to identify the drum charge potential associated with the value.

Figure 3:
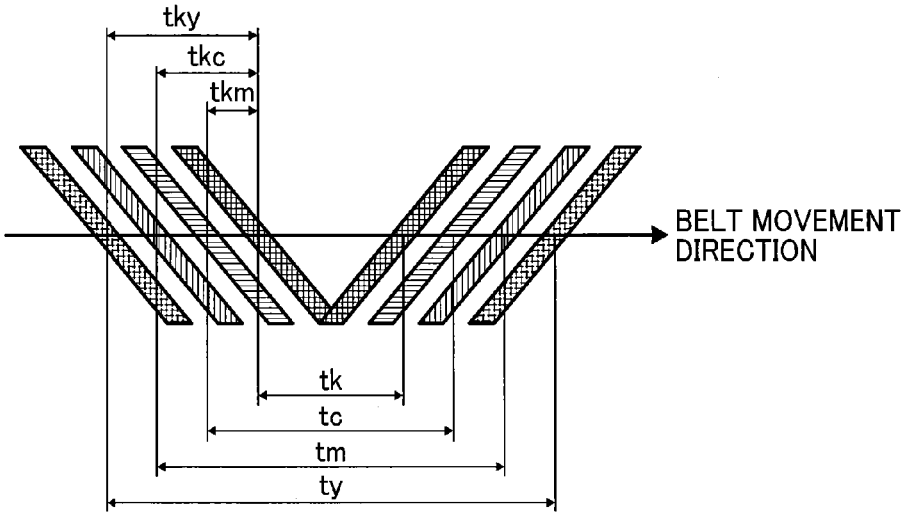
FIG. 3 is an enlarged schematic of a chevron patch formed on the intermediate transfer belt.

The printer of the present embodiment performs a color deviation amount correction process every time the power is tuned on or a predetermined number of sheets are printed. In the color deviation amount correction process, a color deviation detecting image formed of toner images in each color of Y, M, C, and K that is called a chevron patch PV as illustrated in FIG. 3 is formed at each of one end and the other end of the intermediate transfer belt 8 in the width direction. As illustrated in FIG. 3, the chevron patch PV is a line pattern group in which the toner images in each color of Y, M, C, and K are aligned so as to be inclined about 45 degrees from the main-scanning direction at a predetermined pitch in a belt movement direction that is a sub-scanning direction. The adhering quantity of the chevron patch PV is about 0.3 mg/cm$^2$.

The toner images in each color of each of the chevron patches PV formed at both ends of the intermediate transfer belt 8 in the width direction are detected. Thus, the positions of the toner images in each color both in the main-scanning direction (photosensitive element axis direction) and in the sub-scanning direction (belt movement direction), magnification error in the main-scanning direction, and skew from the main-scanning direction are detected. The main-scanning direction in this embodiment indicates a direction in which the phase of laser light shifts on the photosensitive element surface according to the light reflected on a polygon mirror. The optical sensor 151 reads the detection time differences between the Y, M, and C toner images and the K toner image in such chevron patch PV. As viewed in FIG. 3, the vertical direction of the drawing corresponds to the main-scanning direction. Y, M, C, and K toner images are aligned, and then, K, C, M, and Y toner images that are square to the Y, M, C, and K toner images are further aligned from the left in order. The deviation amount of toner images in each color in the sub-scanning direction, that is, a registration deviation amount is obtained based on the difference between the actual measured values and the theoretical values of detection time differences tyk, tmk, and tck with a reference color K. The optical writing start timing relative to the photosensitive element 1 is corrected based on the registration deviation amount. The correction is performed on each surface of the polygon mirror of an optical writing unit (not illustrated), in other words, on each scanning line pitch as one unit. Thus, the registration deviation of the toner images in each color is reduced. Moreover, the inclination (skew) of the toner images in each color from the main-scanning direction is obtained based on the difference between the deviation amounts in the sub-scanning direction at both ends of the belt. Based on the result, the face tangle error correction of an optical reflecting mirror is performed to reduce the skew deviation of the toner images in each color. As described above, a color deviation correction process is a process for correcting the optical writing start timing and the face tangle based on the timing when each toner image of the chevron patch PV is detected to reduce registration deviation and skew deviation. The forming position of the toner images in each color on the intermediate transfer belt 8 is shifted over time due to temperature change or the like to cause the color deviation of images. Such color deviation correction process can inhibit the occurrence of such color deviation.

When the image forming operation of images having small area is continuously performed, aged toners that keep staying in a developing unit for a long time increases, and thus, the toner charging characteristics deteriorate. Therefore, when the toner is used for image formation, the image quality decreases (developing ability reduction and transfer performance reduction). A refreshing mode for refreshing the inside of the developing unit is set so as to prevent such aged toner from being retained inside the developing unit. In the refreshing mode, the aged toner is ejected to the non-image area of the photosensitive element 1 at a predetermined timing, and a new toner is supplied to the developing unit in which the toner density is lowered after the ejection.

A control unit (not illustrated) stores the quantity of toner consumption of each of the developing units 5Y, M, C, and K and the operation time of each of the developing units 5Y, M, C, and K. The control unit checks at a predetermined timing whether the quantity of toner consumption is equal to or less than the threshold value relative to the operation time of the developing unit in a predetermined period. Subsequently, the control unit performs the refreshing mode on the developing unit in which the quantity of toner consumption is equal to or less than the threshold value.

When the refreshing mode is performed, a toner consumption pattern is produced in a non-image formation area on the photosensitive element corresponding to the position between sheets and is transferred to the intermediate transfer belt 8. The adhering quantity of the toner consumption pattern is determined based on the quantity of toner consumption relative to the operation time of the developing unit in a predetermined period. The maximum adhering quantity per unit area may be about 1.0 mg/cm$^2$. The measurement result of toner Q/d distribution of the toner consumption pattern transferred to the intermediate transfer belt 8 is almost aligned with the normally charged polarity.

The belt cleaning device 100 recovers the tone patterns in each color, the chevron patch, and the toner consumption pattern that are formed on the intermediate transfer belt 8. In this process, the belt cleaning device 100 needs to remove a large amount of the toner from the intermediate transfer belt 8. However, a cleaning device that includes a conventional polarity control unit and a brush roller and a cleaning device that includes a brush roller removing a toner having a positive polarity and a brush roller removing a toner having a negative polarity cannot remove untransferred toner images only once such as the tone patterns in each color, the chevron patch, and the toner consumption pattern. With such cleaning devices, the unremoved toner on the intermediate transfer belt 8 may be transferred onto a recording sheet during the subsequent printing operation to produce an abnormal image.

Therefore, the belt cleaning device 100 of the printer of the present embodiment is structured so that the untransferred toner images such as the tone patterns in each color, the chevron patch, and the toner consumption pattern can be removed just once. The details are described below.

Figure 4:
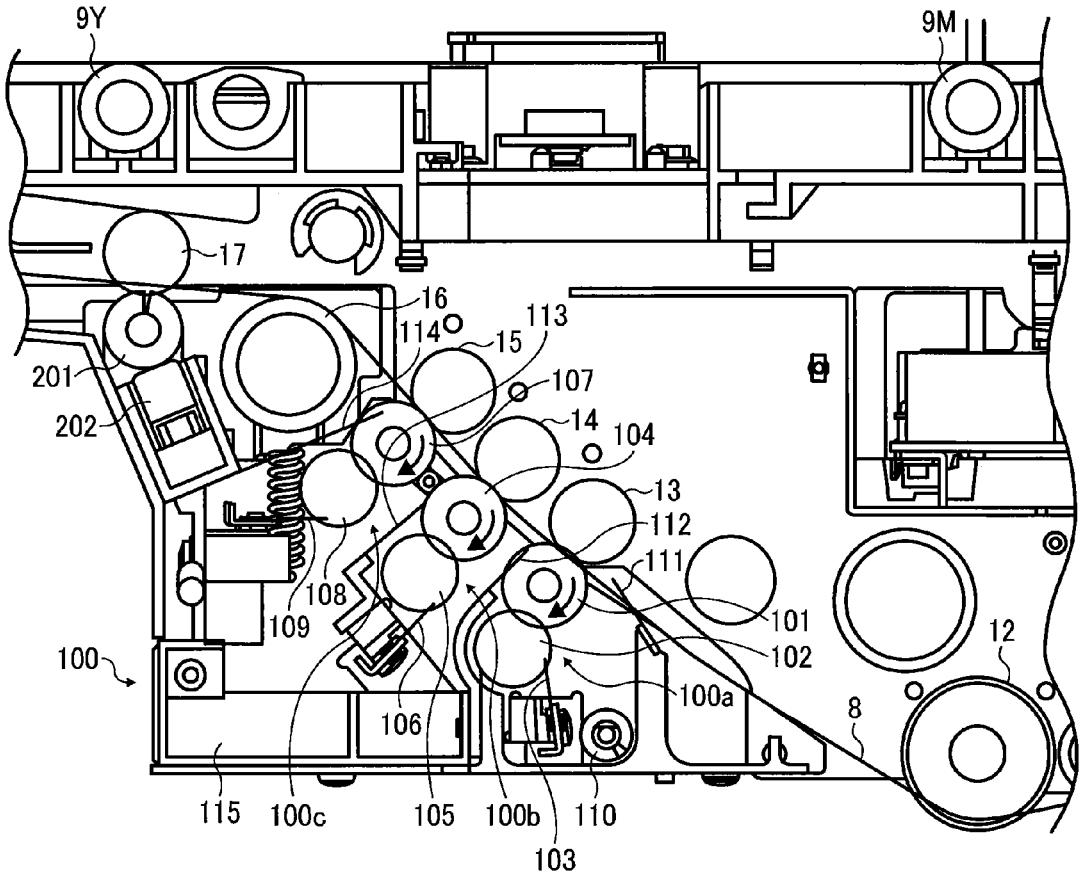
FIG. 4 is an enlarged schematic of a belt cleaning device of the printer and the surroundings.

FIG. 4 is an enlarged schematic of the belt cleaning device 100 of the printer of the present embodiment and the surroundings.

In FIG. 4, the belt cleaning device 100 includes: a pre-cleaning unit 100*a* for roughly removing untransferred toner images on the intermediate transfer belt 8; a reversely charged toner cleaning unit 100*b* for removing the toner charged to a reversed polarity (positive polarity) relative to a normally charged polarity (negative polarity) on the intermediate transfer belt 8; and a normally charged toner cleaning unit 100*c* for removing the toner charged to the normally charged polarity on the intermediate transfer belt 8.

Figure 5:
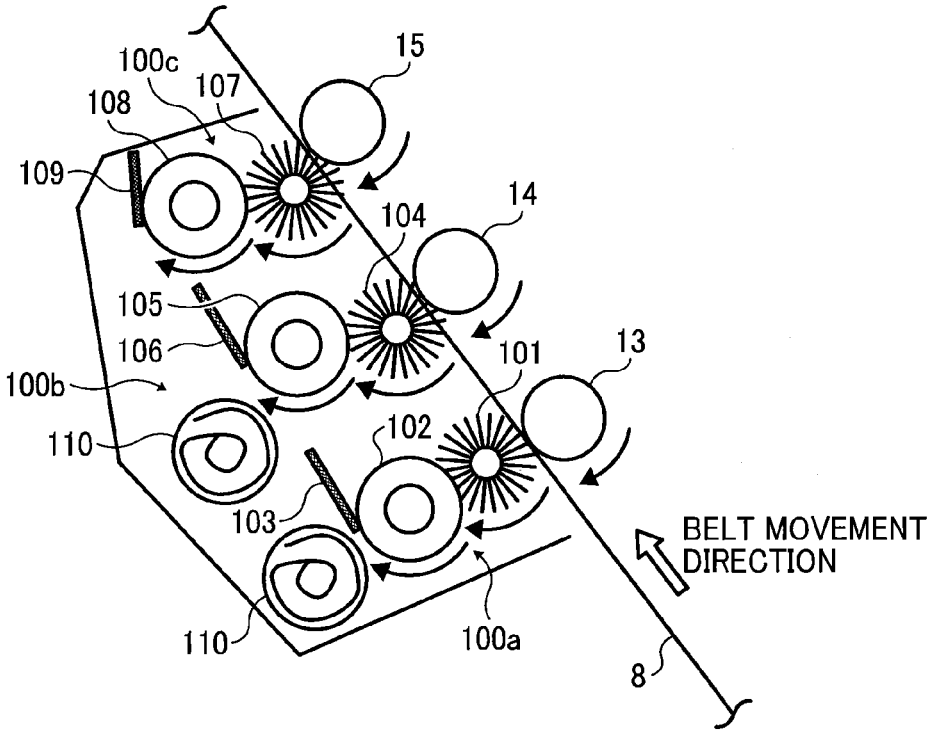
FIG. 5 is a schematic of an essential portion of the belt cleaning device.

FIG. 5 is a schematic of an essential portion of the belt cleaning device.

The pre-cleaning unit 100*a* includes the pre-cleaning brush roller 101 as a pre-cleaning member. The pre-cleaning unit 100*a* includes a pre-recovery roller 102 as a pre-recovery member that recovers a toner adhering to the pre-cleaning brush roller 101, and a pre-scraping blade 103 as a pre-scraping member that makes contact with the pre-recovery roller 102 and scrapes off the toner from the surface of the roller.

Most of the toner constituting the untransferred toner images is charged to the normally charged polarity (negative polarity). Therefore, the toner having a negative polarity on the intermediate transfer belt 8 is electrostatically removed by applying a voltage having a reversed polarity (positive polarity) relative to the normally charged polarity to the pre-cleaning brush roller 101. A voltage having a positive polarity larger than that of the pre-cleaning brush roller 101 is applied to the pre-recovery roller 102. A voltage applied to the pre-cleaning brush roller 101 and the like are set in the belt cleaning device 100 so that the pre-cleaning brush roller 101 removes 90 percent of the untransferred toner images.

The pre-cleaning unit 100*a* includes a conveying screw 110 as a conveying unit for conveying the toner to a waste toner tank (not illustrated) included in the image forming apparatus main body.

The reversely charged toner cleaning unit 100*b* is arranged downstream of the pre-cleaning unit 100*a* in the movement direction of the intermediate transfer belt 8. The reversely charged toner cleaning unit 100*b* includes the reversely charged toner cleaning brush roller 104 as a reversely charged toner cleaning member for electrostatically removing the toner charged to a reversed polarity (positive polarity) relative to the normally charged polarity (negative polarity) of the toner. The reversely charged toner cleaning unit 100*b* includes a reversely charged toner recovery roller 105 as a reversely charged toner recovery member that recovers a reversely charged toner adhering to the reversely charged toner cleaning brush roller 104, and a reversely charged toner scraping blade 106 as a reversely charged toner scraping member that makes contact with the reversely charged toner recovery roller 105 and scrapes off the reversely charged toner from the surface of the roller. A voltage having a negative polarity is applied to the reversely charged toner cleaning brush roller 104, and a voltage having a negative polarity larger than that of the reversely charged toner cleaning brush roller 104 is applied to the reversely charged toner recovery roller 105. The reversely charged toner cleaning unit 100*b* also functions as a polarity control unit that injects charges having a negative polarity to the toner on the intermediate transfer belt 8 and aligns the charged polarity of the toner on the intermediate transfer belt 8 with the normally charged polarity (negative polarity).

The normally charged toner cleaning unit 100*c* is arranged downstream of the reversely charged toner cleaning unit 100*b* in the movement direction of the intermediate transfer belt 8. The normally charged toner cleaning unit 100*c* includes the normally charged toner cleaning brush roller 107 as a normally charged toner cleaning member for electrostatically removing the toner charged to the normally charged polarity. The normally charged toner cleaning unit 100*c* includes a normally charged toner recovery roller 108 as a normally charged toner recovery member that recovers a normally charged toner adhering to the normally charged toner cleaning brush roller 107, and a normally charged toner scraping blade 109 as a normally charged toner scraping member that makes contact with the normally charged toner recovery roller 108 and scrapes off the normally charged toner from the surface of the roller. A voltage having a positive polarity is applied to the normally charged toner cleaning brush roller 107, and a voltage having a positive polarity larger than that of the normally charged toner cleaning brush roller 107 is applied to the normally charged toner recovery roller 108.

The linear pressure of each scraping blade against the recovery roller is described below. The linear pressure in this embodiment means a force working on a contact portion between the surfaces of the scraping blade and the recovery roller per unit length in a direction of the rotating shaft of the recovery roller.

Figure 6:
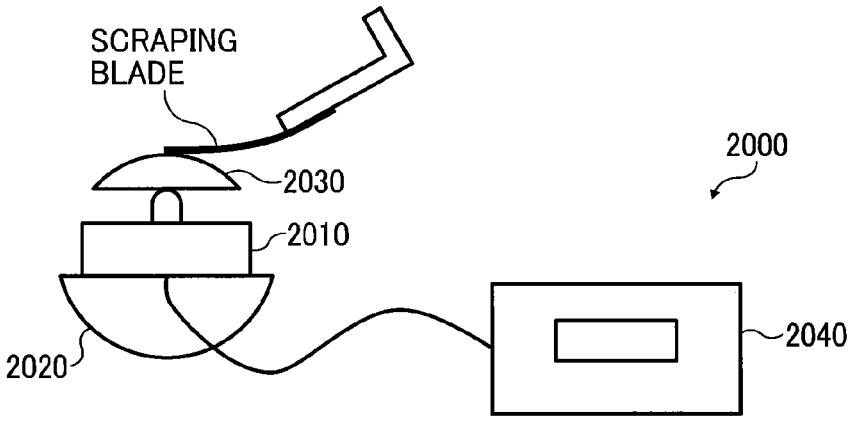
FIG. 6 is a schematic of a measurement device for measuring the linear pressure of each scraping blade.

FIG. 6 is a schematic of a measurement device 2000 for measuring the linear pressure of each of the scraping blades.

In practice, the measurement device 2000 includes a commercially available sensor conditioner "WGA-710B (manufactured by Kyowa Electronic Instruments Co., Ltd.)" and load cell "LMA-A-20N (manufactured by Kyowa Electronic Instruments Co., Ltd.)". The measurement device 2000 includes three load cells 2010. Each of the load cells 2010 is fixed on a cell stage 2020 having a semicylindrical shape. The load cells 2010 are fixed at three different points in total: one is at the center of the scraping blade in the longitudinal direction; and the other two are at both ends in the longitudinal direction at predetermined distances from the center. Jigs 2030 that have a curved surface having the same curvature radius as the recovery roller are loaded on the load cells 2010. Three of the jigs 2030 are aligned in line along the longitudinal direction of the scraping blade. Each of the load cells 2010 is set at the center of the bottom surface of each of the jigs 2030.

The scraping blade is set on the measurement device 2000 such that a positional relation with the jigs 2030 is to be the same as that with the recovery roller.

A linear pressure (N/cm) is calculated by dividing the total load of summing values of the load cells 2010 displayed on a sensor conditioner 2040 by the length of the scraping blade in the longitudinal direction using the measurement device 2000.

Figure 7:
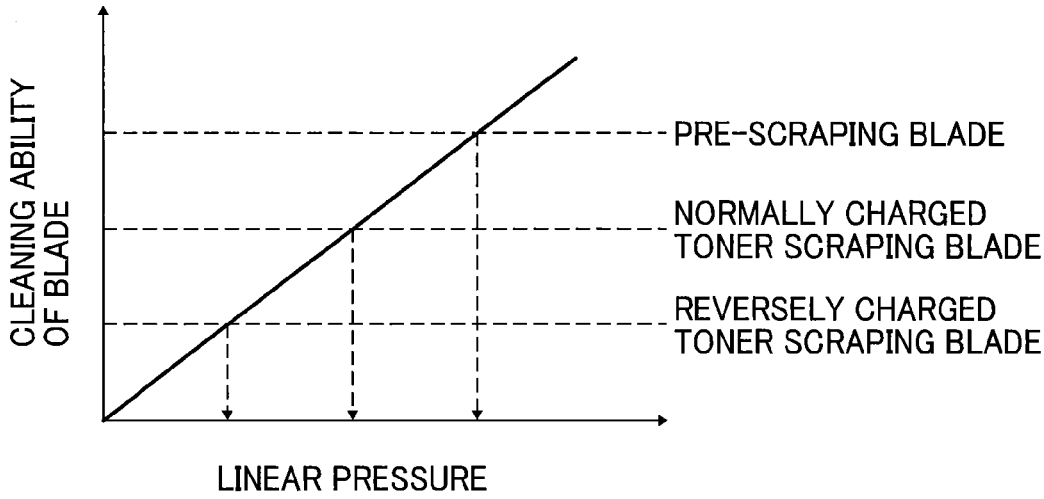
FIG. 7 is a graph illustrating a relationship between the linear pressure of the scraping blade against each recovery roller and the ability (cleaning ability) of the scraping blade for scraping off a toner on the surface of the recovery roller.

FIG. 7 is a graph illustrating a relationship between the linear pressure of each of the scraping blades against each of the recovery rollers and the ability (cleaning ability) of the scraping blade for scraping off a toner on the surface of the recovery roller. As illustrated in FIG. 7, the scraping ability of the scraping blade increases as the linear pressure of the scraping blade against the recovery roller increases.

Figure 8:
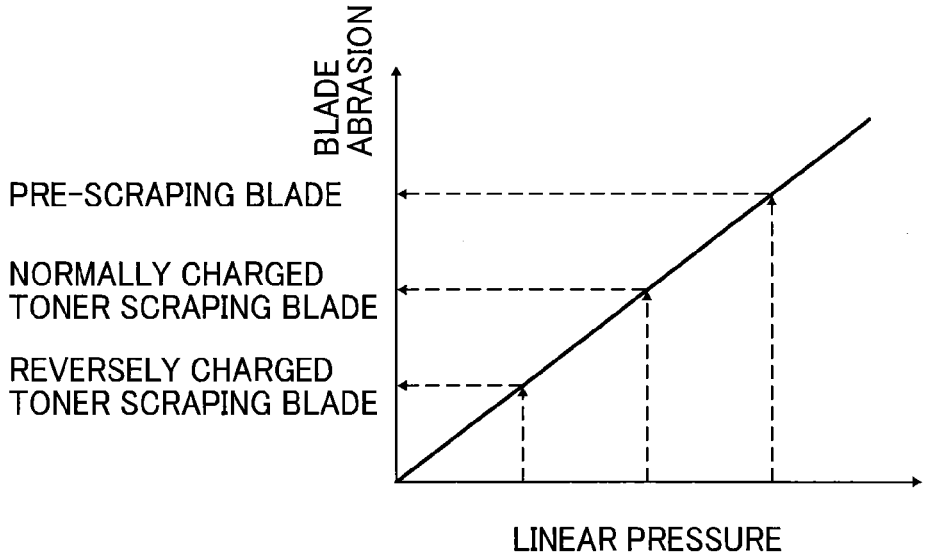
FIG. 8 is a graph illustrating a relationship between the linear pressure of the scraping blade against the recovery roller and the abrasion of the scraping blade.

FIG. 8 is a graph illustrating a relationship between the linear pressure of the scraping blade against the recovery roller and the abrasion of the scraping blade. As illustrated in FIG. 8, the abrasion loss of the scraping blade increases as the linear pressure of the scraping blade against the recovery roller increases to shorten the service life of the scraping blade. When the linear pressure is high, the driving torque of the recovery roller may increase, and the heat value of the scraping blade may increase due to the friction with the recovery roller. When the heat value of the scraping blade increases, the toner entering the contact portion between the scraping blade and the recovery roller may be melted by the heat of the scraping blade and be fixed to the scraping blade.

The inconvenience described above (abrasion, torque increases, and toner fixing) caused by the increase of the linear pressure of the scraping blade against the recovery roller can be inhibited by entering the toner into the contact portion between the scraping blade and the recovery roller to some extent. This is because, the toner entering the contact portion functions as a lubricant to inhibit the friction between the scraping blade and the recovery roller.

As described above, the cleaning device of the present embodiment includes the pre-cleaning unit 100*a*, and the pre-cleaning brush roller 101 is set to enable the removal of 90 percent of the untransferred toner images. Therefore, the toner amount entering the reversely charged toner cleaning unit 100*b* and the normally charged toner cleaning unit 100*c* is smaller than that of the pre-cleaning unit 100*a*. Accordingly, the toner amount entering the contact portion between the reversely charged toner scraping blade 106 and the reversely charged toner recovery roller 105, and the toner amount entering the contact portion between the normally charged toner scraping blade 109 and the normally charged toner recovery roller 108 are smaller than the toner amount entering the contact portion between the pre-scraping blade 103 and the pre-recovery roller 102.

Therefore, the following structure causes the inconvenience described above (abrasion, torque increases, and toner fixing) at the reversely charged toner cleaning unit 100*b* and the normally charged toner cleaning unit 100*c*. The linear pressure of the reversely charged toner scraping blade 106 against the reversely charged toner recovery roller 105 and the linear pressure of the normally charged toner scraping blade 109 against the normally charged toner recovery roller 108 are set to be the same as the linear pressure of the pre-scraping blade 103 against the pre-recovery roller 102.

Accordingly, as illustrated in FIGS. 7 and 8, the linear pressure of the scraping blade in the belt cleaning device 100 of the present embodiment satisfies the relationship: the pre-scraping blade 103>the normally charged toner scraping blade 109>the reversely charged toner scraping blade 106.

The linear pressure of the reversely charged toner scraping blade 106 against the reversely charged toner recovery roller 105 and the linear pressure of the normally charged toner scraping blade 109 against the normally charged toner recovery roller 108 are set to be smaller than the linear pressure of the pre-scraping blade 103 against the pre-recovery roller 102. The linear pressures thus remain small even when the toner amount entering the contact portion between the reversely charged toner scraping blade 106 and the reversely charged toner recovery roller 105, and the toner amount entering the contact portion between the normally charged toner scraping blade 109 and the normally charged toner recovery roller 108 are small, resulting in an insufficient effect of the toner as a lubricant. Therefore, the friction between the scraping blade and the recovery roller can be inhibited. The inhibition of the friction can inhibit the abrasion of the reversely charged toner scraping blade 106 and the normally charged toner scraping blade 109, the torque increases of the reversely charged toner recovery roller 105 and the normally charged toner recovery roller 108, and the fixing of the toner to the reversely charged toner scraping blade 106 and the normally charged toner scraping blade 109. As illustrated in FIG. 7, when the linear pressure decreases, the cleaning abilities of the reversely charged toner scraping blade 106 and the normally charged toner scraping blade 109 also decrease as compared with that of the pre-scraping blade 103. However, a small amount of the toner enters the contact portion between the reversely charged toner scraping blade 106 and the reversely charged toner recovery roller 105. Therefore, even when the scraping ability of the reversely charged toner scraping blade 106 decreases, the toner on the surface of the reversely charged toner recovery roller can be favorably scraped off. Similarly, a small amount of the toner enters the contact portion between the normally charged toner scraping blade 109 and the normally charged toner recovery roller 108. Therefore, even when the cleaning ability of the normally charged toner scraping blade 109 decreases, the toner on the surface of the recovery roller can be favorably scraped off.

In contrast, a large amount of the toner enters the contact portion between the pre-scraping blade 103 and the pre-recovery roller 102, and therefore, the toner entering the contact portion between the pre-scraping blade 103 and the pre-recovery roller 102 can sufficiently have an effect as a lubricant. Accordingly, even when the linear pressure of the pre-scraping blade 103 against the pre-recovery roller 102 is high, the friction between the pre-recovery roller 102 and the pre-scraping blade 103 can be inhibited. As a result, the abrasion of the pre-scraping blade 103, the torque increase of the pre-recovery roller 102, and the fixing of the toner to the pre-scraping blade 103 can be inhibited. The scraping ability of the pre-scraping blade 103 is high because the linear pressure of the pre-scraping blade 103 against the pre-recovery roller 102 is high. Accordingly, even when a large amount of the toner enters the portion between the pre-scraping blade 103 and the pre-recovery roller 102, the pre-scraping blade 103 can favorably scrape the toner on the pre-recovery roller 102 off.

In the belt cleaning device 100 of the present embodiment, the reversely charged toner cleaning unit 100*b* injects charges having a negative polarity to the toner on the intermediate transfer belt 8 and aligns the charged polarity of the toner on the intermediate transfer belt 8 with the normally charged polarity (negative polarity) to perform polarity control. Therefore, the toner amount removed by the reversely charged toner cleaning unit 100*b* is smaller than that by the normally charged toner cleaning unit 100*c*. Accordingly, the toner amount entering the contact portion between the reversely charged toner scraping blade 106 and the reversely charged toner recovery roller 105 is smaller than the toner amount entering the contact portion between the normally charged toner scraping blade 109 and the normally charged toner recovery roller 108. Therefore, the effect of the toner entering the contact portion between the scraping blade and the recovery roller as a lubricant that works on the reversely charged toner cleaning unit 100*b* is smaller than that on the normally charged toner cleaning unit 100*c*. The linear pressure of the reversely charged toner scraping blade 106 against the reversely charged toner recovery roller 105 is set to be the same as the linear pressure of the normally charged toner scraping blade 109 against the normally charged toner recovery roller 108. In this structure, the abrasion of the scraping blade, the torque increase of the recovery roller, and the fixing of the toner to the scraping blade 106 that are caused in the reversely charged toner cleaning unit 100*b* are worse than those in the normally charged toner cleaning unit 100*c*.

Accordingly, the linear pressure of the reversely charged toner scraping blade 106 against the reversely charged toner recovery roller 105 is set to be smaller than the linear pressure of the normally charged toner scraping blade 109 against the normally charged toner recovery roller 108. This structure can inhibit the abrasion of the reversely charged toner scraping blade 106, the torque increase of the reversely charged toner recovery roller 105, and the fixing of the toner to the reversely charged toner scraping blade 106. The linear pressure of the reversely charged toner scraping blade 106 against the reversely charged toner recovery roller 105 is set to be smaller than the linear pressure of the normally charged toner scraping blade 109 against the normally charged toner recovery roller 108. As illustrated in FIG. 7, in this structure, the scraping ability of the reversely charged toner scraping blade 106 decreases as compared with the scraping ability of the normally charged toner scraping blade 109. However, the toner amount entering the contact portion between the reversely charged toner scraping blade 106 and the reversely charged toner recovery roller 105 is smaller than the toner amount entering the portion between the normally charged toner scraping blade 109 and the normally charged toner recovery roller 108. Accordingly, even when the cleaning ability of the reversely charged toner scraping blade 106 is smaller than the cleaning ability of the normally charged toner scraping blade 109, the toner on the surface of the reversely charged toner recovery roller can be favorably scraped off.

Figure 9:
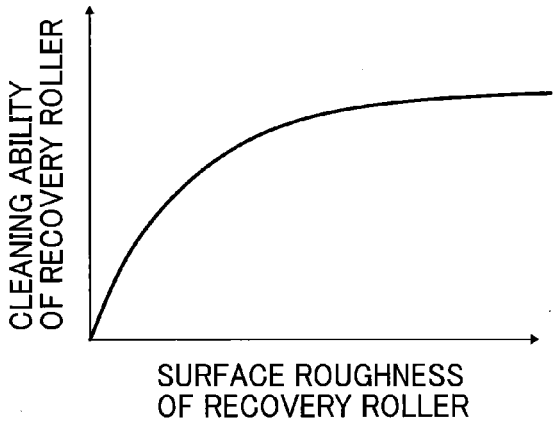
FIG. 9 is a graph illustrating a relationship between the surface roughness Ra of the recovery roller and the toner recovery ability (cleaning ability) of the recovery roller from each cleaning brush roller.

FIG. 9 is a graph illustrating a relationship between the surface roughness Ra of the recovery roller and the toner recovery ability (cleaning ability) of the recovery roller from the cleaning brush roller. As illustrated in FIG. 9, when the surface roughness Ra of the recovery roller is large to some extent, the toner recovery ability from the cleaning brush is high. This is because, the toner is apt to be caught in the recovery roller having a large surface toughness Ra while the toner moves from the cleaning brush roller to the recovery roller.

Figure 10:
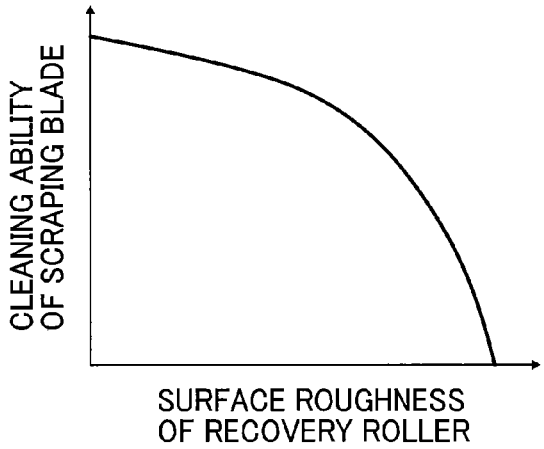
FIG. 10 is a graph illustrating a relationship between the surface roughness Ra of the recovery roller and the ability (cleaning ability) of the scraping blade for scraping off a toner on the surface of the recovery roller.

FIG. 10 is a graph illustrating a relationship between the surface roughness Ra of the recovery roller and the ability (cleaning ability) of the scraping blade for scraping off the toner on the surface of the recovery roller. As illustrated in FIG. 10, the cleaning ability of the scraping blade decreases as the surface roughness Ra of the recovery roller increases. This is because, when the surface roughness of the recovery roller increases, the toner is apt to get into under the scraping blade. Moreover, when the surface roughness of the recovery roller increases, the heat value of the scraping blade increases due to the friction of the scraping blade to easily adversely generate heat.

Figure 11:
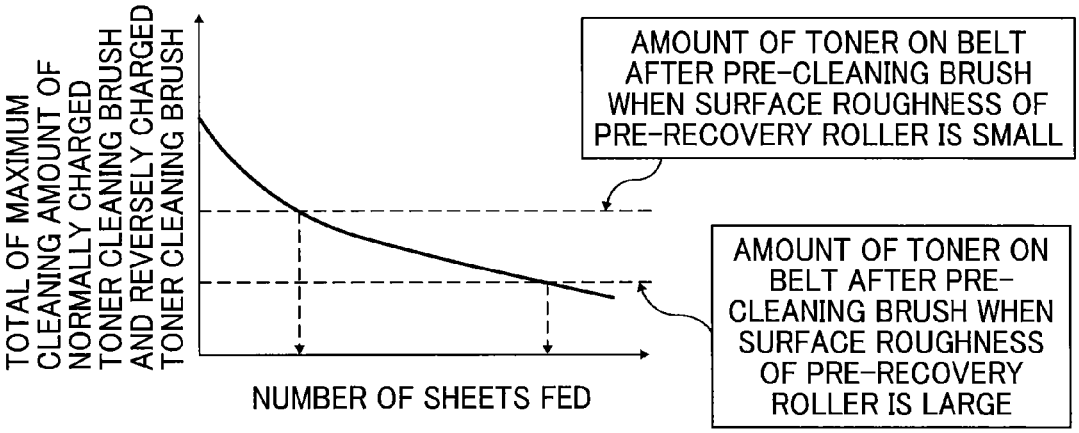
FIG. 11 is a graph illustrating a relationship between the number of sheets fed and the total of the maximum cleaning abilities of a normally charged toner cleaning brush roller and a reversely charged toner cleaning brush roller.

FIG. 11 is a graph illustrating a relationship between the number of sheets fed and the total of the maximum cleaning amount capable of being cleaned by the normally charged toner cleaning brush roller 107 and the reversely charged toner cleaning brush roller 104. As illustrated in FIG. 11, when the number of sheets fed increases, the cleaning abilities of the normally charged toner cleaning brush roller 107 and the reversely charged toner cleaning brush roller 104 decrease due to the collapsing of the bristles of the brush to reduce the maximum cleaning amount capable of being cleaned. As illustrated in FIG. 11, when the surface roughness Ra of the pre-recovery roller is small, a large amount of the toner remains on the intermediate transfer belt 8 after the toner has passed the pre-cleaning brush roller 101. This is because, the toner adhering to the pre-recovery roller 102 from the pre-cleaning brush roller 101 decreases, and the toner remaining on the pre-cleaning brush roller 101 increases. The toner remaining on the pre-cleaning brush roller 101 is injected with charges or the like to be a reversely charged toner to adhere to the intermediate transfer belt 8 again. The toner remaining on the pre-cleaning brush roller 101 causes the reduction of the toner amount newly adhering to the pre-cleaning brush roller 101 to lower the cleaning ability of the pre-cleaning brush roller 101. Therefore, when the surface roughness Ra of the pre-recovery roller is small, the toner amount remaining on the intermediate transfer belt 8 after the toner has passed the pre-cleaning brush roller 101 is large as compared with the toner amount when the surface roughness Ra of the pre-recovery roller is large. As described above, when the surface roughness Ra of the pre-recovery roller is small, the toner remaining on the intermediate transfer belt 8 becomes large. Thus, the toner amount removed by the reversely charged toner cleaning brush roller 104 and the normally charged toner cleaning brush roller becomes large, which causes cleaning failure in an early stage. In contrast, when the surface roughness Ra of the pre-recovery roller is large, the toner remaining on the intermediate transfer belt becomes small. Thus, the amount of the toner to be removed by the reversely charged toner cleaning brush roller 104 and the normally charged toner cleaning brush roller is small. Accordingly, as illustrated in FIG. 11, the occurrence of the cleaning failure can be inhibited for a long period.

Thus, the cleaning failure can be inhibited for a long period by increasing the surface roughness Ra of the pre-recovery roller 102 to some extent. As a result, the reversely charged toner cleaning brush roller 104 and the normally charged toner cleaning brush roller 107 at the downstream can be continuously used even when the bristles are collapsed a little to lower the cleaning abilities. Consequently, the service life of the reversely charged toner cleaning brush roller 104 and the normally charged toner cleaning brush roller 107 at the downstream can be lengthened.

As illustrated in FIG. 10, when the surface roughness Ra of the pre-recovery roller 102 increases, the cleaning ability of the pre-scraping blade 103 may decrease, and the heat value of the pre-scraping blade 103 may increase. However, as described above, the linear pressure of the pre-scraping blade 103 is set to be large, and thus, even when the surface of the pre-recovery roller 102 is rough, the toner on the surface of the pre-recovery roller 102 can be favorably scraped off. A large amount of the toner enters the contact portion between the pre-recovery roller 102 and the pre-scraping blade 103, and therefore, the toner entering the contact portion between the pre-scraping blade 103 and the pre-recovery roller 102 can sufficiently have an effect as a lubricant. Accordingly, even when the linear pressure of the pre-scraping blade 103 against the pre-recovery roller 102 is high and the surface roughness Ra of the pre-recovery roller 102 is large, the heat generation of the pre-scraping blade 103 can be suppressed. Therefore, in the pre-cleaning unit 100*a*, the cleaning ability of the pre-scraping blade 103 can be inhibited from decreasing, and the toner fixing due to the heat generation of the pre-scraping blade 103 can be inhibited even when the surface roughness Ra of the pre-recovery roller is large to some extent.

On the other hand, the linear pressures of the reversely charged toner scraping blade 106 and the normally charged toner scraping blade 109 are reduced to lower the scraping abilities. Therefore, when the surface roughness of the reversely charged toner recovery roller 105 and the surface roughness of the normally charged toner recovery roller 108 are set to be the same as the surface roughness of the pre-recovery roller 102, the scraping blades cannot favorably scrape off the toner on the surfaces of the recovery rollers. A small amount of the toner enters the contact portion between the reversely charged toner scraping blade 106 and the reversely charged toner recovery roller 105, a small amount of the toner enters the contact portion between the normally charged toner scraping blade 109 and the normally charged toner recovery roller 108, and thus, the toner cannot have a sufficient effect as a lubricant. The surface roughness Ra of the reversely charged toner recovery roller 105 and the surface roughness Ra of the normally charged toner recovery roller 108 are set to be the same as the surface roughness Ra of the pre-recovery roller 102. In this structure, the heat values of the reversely charged toner scraping blade 106 and the normally charged toner scraping blade 109 may increase to fix the toner to the reversely charged toner scraping blade 106 and the normally charged toner scraping blade 109.

Accordingly, the surface roughness Ra of the reversely charged toner recovery roller 105 and the surface roughness Ra of the normally charged toner recovery roller 108 are set to be smaller than the surface roughness Ra of the pre-recovery roller 102. Subsequently, the toner on the surface of the reversely charged toner recovery roller 105 can be favorably scraped off even when the linear pressure of the reversely charged toner scraping blade 106 is small. The heat generation due to the friction of the reversely charged toner scraping blade 106 can be suppressed, which can inhibit the fixing of the toner to the reversely charged toner scraping blade 106. Similarly, the toner on the surface of the normally charged toner recovery roller 108 can be favorably scraped off even when the linear pressure of the normally charged toner scraping blade 109 is small. The heat generation due to the friction of the normally charged toner scraping blade 109 can be suppressed, which can inhibit the fixing of the toner to the normally charged toner scraping blade 109. When the surface roughness Ra of the reversely charged toner recovery roller 105 and the surface roughness Ra of the normally charged toner recovery roller 108 are set to be small, the toner recovery abilities of these recovery rollers 105 and 108 decrease. However, the amount of the toner to be removed by the reversely charged toner cleaning brush roller 104 and the normally charged toner cleaning brush roller 107 is small. Therefore, even when the surface roughness Ra of the reversely charged toner recovery roller 105 and the surface roughness Ra of the normally charged toner recovery roller 108 are small, the toner adhering to the cleaning brush rollers can be favorably recovered by the recovery rollers. Accordingly, the toner can be inhibited from remaining on the normally charged toner cleaning brush roller 107 and the reversely charged toner cleaning brush roller 104 without being recovered by the recovery rollers.

As described above, the reversely charged toner cleaning unit 100*b* also performs a process for aligning the polarity of the toner on the intermediate transfer belt 8 with the normally charged polarity (negative polarity). Therefore, the toner amount adhering to the reversely charged toner cleaning brush roller 104 is smaller than the toner amount adhering to the normally charged toner cleaning brush roller 107. Accordingly, the toner amount recovered by the reversely charged toner recovery roller 105 is smaller than the toner amount recovered by the normally charged toner recovery roller 108. Therefore, the surface roughness of the reversely charged toner recovery roller 105 is preferably set to be smaller than the surface roughness Ra of the normally charged toner recovery roller 108. As a result, the heat generation of the reversely charged toner scraping blade 106 can be suppressed, which can inhibit the fixing of the toner to the reversely charged toner scraping blade 106.

The pre-cleaning unit 100*a* and the reversely charged toner cleaning unit 100*b* are partitioned with a first insulating sealing member 112, and the first insulating sealing member 112 makes contact with the pre-cleaning brush roller 101. By partitioning the pre-cleaning unit 100*a* and the reversely charged toner cleaning unit 100*b* with the first insulating sealing member 112, electric discharge can be inhibited from occurring between the pre-cleaning brush roller 101 and the reversely charged toner cleaning brush roller 104. Moreover, the toner removed by the reversely charged toner cleaning unit 100*b* can be inhibited from adhering to the pre-cleaning brush again.

The reversely charged toner cleaning unit 100*b* and the normally charged toner cleaning unit 100*c* are partitioned with a second insulating sealing member, and a second insulating sealing member 113 makes contact with the reversely charged toner cleaning brush roller 104. By partitioning the reversely charged toner cleaning unit 100*b* and the normally charged toner cleaning unit 100*c* with the second insulating sealing member 113, electric discharge can be inhibited from occurring between the reversely charged toner cleaning brush roller 104 and the normally charged toner cleaning brush roller 107. Moreover, the toner removed by the normally charged toner cleaning unit 100*c* can be inhibited from adhering to the reversely charged toner cleaning brush roller 104 again.

A third insulating sealing member 114 making contact with the normally charged toner cleaning brush roller 107 is provided at the outlet of the cleaning device 100. Thus, the electric discharge can be inhibited from occurring between the normally charged toner cleaning brush roller 107 and the tension roller 16.

The belt cleaning device 100 also includes an inlet seal 111 and a waste toner case 115. The waste toner case 115 reserves the toner removed by the reversely charged toner cleaning unit 100*b* and the normally charged toner cleaning unit 100*c*. The waste toner case 115 is detachably fixed to the belt cleaning device 100 and can be detached from the cleaning device 100 during the maintenance or the like to remove the toner accumulated in the waste toner case 115.

In the belt cleaning device 100 of the present embodiment, the waste toner case 115 reserves the toner removed by the reversely charged toner cleaning unit 100*b* and the normally charged toner cleaning unit 100*c*, but it is not limited to the structure. For example, a conveying member that conveys the toner to the conveying screw 110 may be provided at the bottom of the belt cleaning device 100, and the bottom may be inclined so as to be directed to the conveying screw 110. Thus, the toner removed by the reversely charged toner cleaning unit 100*b* and the normally charged toner cleaning unit 100*c* may also be conveyed to the waste toner tank (not illustrated) provided at the image forming apparatus main body by the conveying screw 110. A second conveying screw that conveys the toner removed by the reversely charged toner cleaning unit 100*b* and the normally charged toner cleaning unit 100*c* to the waste toner tank (not illustrated) provided at the image forming apparatus main body may be provided in addition to the conveying screw.

Each of the cleaning brush rollers 101, 104, and 107 includes a metal rotating shaft member rotatably supported and a brush portion formed of a plurality of bristles arranged in a standing manner at the circumferential surface of the shaft member and has an outer diameter of ϕ 15 millimeters to ϕ 16 millimeters. The bristles have a core-sheath structure of a two-layered structure whose inside is made of conductive materials such as conductive carbons and whose surface portion is made of insulating materials such as polyesters. With the structure, the electric potential of the core becomes substantially the same as the electric potential of the voltage applied to the cleaning brush roller, and thus, the toner can be electrostatically attracted to the surface of the bristles. As a result, the toner on the intermediate transfer belt 8 electrostatically adheres to the bristles by the action of the voltage applied to the cleaning brush roller. The bristles of the cleaning brush rollers 101, 104, and 107 may also be made of conductive fibers alone. The bristles may also be so-called inclined bristles that are planted so as to be inclined relative to the normal direction of the rotating shaft member. The bristles of the pre-cleaning brush roller 101 and the normally charged toner cleaning brush roller 107 may have a core-sheath structure while the bristles of the reversely charged toner cleaning brush roller 104 are constituted of conductive fibers alone. By constituting the bristles of the reversely charged toner cleaning brush roller 104 with conductive fibers alone, charge injection easily occurs from the reversely charged toner cleaning brush roller 104 to the toner. Accordingly, the polarity of the toner on the intermediate transfer belt 8 can be favorably aligned with a negative polarity by the reversely charged toner cleaning brush roller 104. Meanwhile, by making the bristles of the pre-cleaning brush roller 101 and the normally charged toner cleaning brush roller 107 have the core-sheath structure, charge injection to the toner can be inhibited, which inhibits the toner on the intermediate transfer belt 8 from being charged to a positive polarity. Thus, the pre-cleaning brush roller 101 and the normally charged toner cleaning brush roller 107 can inhibit to produce the toner that cannot be electrostatically removed.

Each of the cleaning brush rollers 101, 104, and 107 is placed so as to dig into the intermediate transfer belt 8 for 1 millimeter and rotates so that the bristles moves in a direction (counter direction) opposite to the movement direction of the intermediate transfer belt 8 at the contact position by a driving unit (not illustrated). The difference of the linear velocities between the cleaning brush roller and the intermediate transfer belt 8 can be enlarged by rotating the roller so that the bristles move in the counter direction at the contact portion. With this structure, contact probability between a certain portion of the intermediate transfer belt 8 and the bristles increases while the certain portion passes through the contact range with the cleaning brush roller, and thus, the toner can be favorably removed from the intermediate transfer belt 8.

In the belt cleaning device 100 of the present embodiment, stainless steel (SUS) rollers are used for the recovery rollers 102, 105, and 108. Each of the recovery rollers 102, 105, and 108 may be made of any materials so long as the recovery roller has function to dislocate the toner adhering to the brush roller due to the electric potential gradient between the bristles and the recovery roller. For example, each of the recovery rollers 102, 105, and 108 may employ a roller including a conductive core that is coated with high resistance elastic tube having a thickness of several micrometers to 100 micrometers or that is further coated with insulating coating so that the resistance of the roller satisfies log R=12 ohms to 13 ohms. The use of SUS rollers for the recovery rollers 102, 105, and 108 can advantageously reduce costs, keep the applied voltage low, and reduce power consumption. By setting the resistance of the roller so as to satisfy log R=12 ohms to 13 ohms, charge injection to the toner while the toner is recovered by the recovery roller can be inhibited. Thus, the toner can be inhibited from having a polarity same as the polarity of the applied voltage of the recovery roller to lower the toner recovery rate.

The normally charged toner cleaning unit 100*c* is arranged downstream of the reversely charged toner cleaning unit 100*b* in the movement direction of the intermediate transfer belt 8. The normally charged toner cleaning unit 100*c* includes the normally charged toner cleaning brush roller 107 as a normally charged toner cleaning member for electrostatically removing the toner charged to the normally charged polarity. The normally charged toner cleaning unit 100*c* includes the normally charged toner recovery roller 108 as a normally charged toner recovery member that recovers the normally charged toner adhering to the normally charged toner cleaning brush roller 107, and the normally charged toner scraping blade 109 as a normally charged toner scraping member that makes contact with the normally charged toner recovery roller 108 and scrapes off the normally charged toner from the surface of the roller. A voltage having a positive polarity is applied to the normally charged toner cleaning brush roller 107, and a voltage having a negative polarity larger than that of the normally charged toner cleaning brush roller 107 is applied to the normally charged toner recovery roller 108.

Each of the cleaning counter rollers 13, 14, and 15 is an aluminum roller having a diameter of ϕ 14 millimeters and is driven in rotation by the frictional force between the intermediate transfer belt 8 and the surface of the roller itself. The cleaning counter rollers 13, 14, and 15 are connected to the ground.

The following is the condition of each of the cleaning brush rollers 101, 104, and 107.

Brush material: conductive polyesters (having a so-called core-sheath structure that includes conductive carbons at the inside of the fiber and polyesters at the surface of the fiber)

Brush resistance: $10^6$ ohms to $10^8$ ohms

Applied voltage to rotating shaft member (V)

Pre-cleaning brush roller: +1600 volts to 2000 volts

Reversely charged toner cleaning brush roller: −2000 volts to −2400 volts

Normally charged toner cleaning brush roller: 800 volts to 1200 volts

Brush planting density: 100,000/inch2

Brush fiber diameter: about 25 micrometers to 35 micrometers

Collapsing treatment of bristles at brush end: Treated

Brush diameter ϕ: 15 millimeters to 16 millimeters

The applied voltage to the pre-cleaning brush roller 101 is set so as to obtain a favorable cleaning performance when an untransferred toner image containing a large amount of the toner adhering to the intermediate transfer belt 8 enters the roller. The applied voltage to the reversely charged toner cleaning brush roller 104 is set to be high so that charges are injected to the toner on the intermediate transfer belt 8. The brush planting density, brush resistance, fiber diameter, applied voltage, fiber types, and brush fiber dug amount can be optimized by the system and thus are not limited to them. The type of available fibers is, for example, nylon, acrylic, and polyesters.

The following is the condition of each of the recovery rollers 102, 105, and 108.

Recovery roller core material: SUS303-G8

Applied voltage to recovery roller core:

Pre-recovery roller: 2000 volts to 2400 volts

Reversely charged toner recovery roller: −2400 volts to −2800 volts

Normally charged toner recovery roller: +1000 volts to +1400 volts

Surface roughness Ra of the pre-recovery roller 102: 1.6

Surface roughness Ra of the reversely charged toner recovery roller 105: 0.4

Surface roughness Ra of the normally charged toner recovery roller 108: 0.8

The recovery roller material, brush fiber dug amount, applied voltage, and surface roughness Ra can be optimized by the system and thus are not limited to them.

The following is the condition of each of the scraping blades 103, 106, 109.

Blade contact angle: 20 degrees

Blade thickness: 0.08 millimeter

Blade material: SUS304H

Blade linear pressure against pre-recovery roller: 69 gf/cm

Blade linear pressure against reversely charged toner recovery roller: 32 gf/cm

Blade linear pressure against normally charged toner recovery roller: 46 gf/cm

The blade contact angle, blade thickness, and linear pressure against recovery roller can be optimized by the system and thus are not limited to them.

The cleaning operation performed by the belt cleaning device 100 of the present embodiment is described below.

As illustrated in FIG. 4, the toner left untransferred and the untransferred toner images passing through the secondary transfer nip pass through the contact portion with the inlet seal 111 and are conveyed to the position of the pre-cleaning brush roller 101 by the rotation of the intermediate transfer belt 8. A voltage having a reversed polarity (positive polarity) relative to the normally charged polarity of the toner is applied to the pre-cleaning brush roller 101. The toner charged to a negative polarity on the intermediate transfer belt 8 is electrostatically adsorbed and moved to the pre-cleaning brush roller 101 by the electric field formed due to the electric potential difference between the surface potentials of the intermediate transfer belt 8 and the pre-cleaning brush roller 101. The toner having a negative polarity and moved to the pre-cleaning brush roller 101 is conveyed to the contact position with the pre-recovery roller 102 to which a voltage having a positive polarity larger than that of the pre-cleaning brush roller 101 is applied. The toner moved onto the pre-cleaning brush roller 101 is electrostatically adsorbed and moved to the pre-recovery roller 102 by the electric field formed due to the electric potential difference between the surface potentials of the pre-cleaning brush roller 101 and the pre-recovery roller 102. The pre-scraping blade 103 scrapes off the toner that has a negative polarity and is moved to the pre-recovery roller 102 from the surface of the recovery roller. The conveying screw 110 discharges the toner scraped off by the pre-scraping blade 103 to the exterior.

The negative polarity toner and the positive polarity toner of the untransferred toner images and the positive polarity toner left untransferred on the intermediate transfer belt 8 that cannot be removed by the pre-cleaning brush roller 101 are conveyed to the position of the reversely charged toner cleaning brush roller 104. A voltage having a polarity (negative polarity) same as the normally charged polarity of the toner is applied to the reversely charged toner cleaning brush roller 104. The polarity of the toner on the intermediate transfer belt 8 is aligned with a negative polarity by charge injection or electric discharge. At the same time, the toner charged to a positive polarity on the intermediate transfer belt 8 is electrostatically adsorbed and moved to the reversely charged toner cleaning brush roller 104 by the electric field formed due to the electric potential difference between the surface potentials of the intermediate transfer belt 8 and the reversely charged toner cleaning brush roller 104. The toner having a positive polarity and moved to the reversely charged toner cleaning brush roller 104 is conveyed to the contact position with the reversely charged toner recovery roller 105 to which a voltage having a negative polarity larger than that of the reversely charged toner cleaning brush roller 104 is applied. The toner moved onto the reversely charged toner cleaning brush roller 104 is electrostatically adsorbed and moved to the reversely charged toner recovery roller 105 by the electric field formed due to the electric potential difference between the surface potentials of the reversely charged toner cleaning brush roller 104 and the reversely charged toner recovery roller 105. The reversely charged toner scraping blade 106 scrapes off the toner that has a positive polarity and is moved to the reversely charged toner recovery roller 105 from the surface of the recovery roller.

The toner shifted to a negative polarity by the reversely charged toner cleaning brush roller 104 and the negative polarity toner that cannot be removed by the pre-cleaning brush roller 101 are conveyed to the normally charged toner cleaning brush roller 107. The polarity of the toner conveyed to the normally charged toner cleaning brush roller 107 is controlled to be a negative polarity by the reversely charged toner cleaning brush roller 104. The pre-cleaning brush roller 101 and the reversely charged toner cleaning brush roller 104 remove most of the toner on the intermediate transfer belt 8. Therefore, the toner conveyed to the normally charged toner cleaning brush roller 107 is a very small amount. The very small amount of the toner on the intermediate transfer belt 8 that is aligned with a negative polarity and is conveyed to the normally charged toner cleaning brush roller 107 is electrostatically adsorbed to the normally charged toner cleaning brush roller 107 to which a voltage having a reversed polarity (positive polarity) relative to the normally charged polarity of the toner is applied. Then, the normally charged toner recovery roller 108 recovers the toner. Subsequently, the normally charged toner scraping blade 109 scrapes off the toner from the normally charged toner recovery roller 108.

In such a manner, the belt cleaning device 100 of the present embodiment includes the pre-cleaning brush roller 101, and the pre-cleaning brush roller 101 roughly removes the toner having a negative polarity that is dominant in the untransferred toner images. This enables the reduction of the toner amount entering the reversely charged toner cleaning brush roller 104 and the normally charged toner cleaning brush roller 107. The toner on the intermediate transfer belt conveyed to the normally charged toner cleaning brush roller 107 at the most downstream in the belt movement direction is the toner that cannot be removed by the pre-cleaning brush roller 101 and the reversely charged toner cleaning brush roller 104. The amount of the toner is very small. The toner is aligned with a negative polarity by the reversely charged toner cleaning brush roller 104. Thus, the normally charged toner cleaning brush roller 107 can favorably remove the remaining toner. Accordingly, the untransferred toner images containing a large amount of the toner adhering to the intermediate transfer belt 8 can also be favorably removed from the intermediate transfer belt 8.

The three of the cleaning brush rollers 101, 104, and 107 can favorably remove the toner left untransferred having a toner amount smaller than that of the untransferred toner images.

In the belt cleaning device 100 of the present embodiment, the reversely charged toner cleaning brush roller 104 removes the toner having a positive polarity on the intermediate transfer belt 8. However, the reversely charged toner cleaning unit 100*b* may be changed to a polarity control unit to have a structure that does not remove the toner having a positive polarity on the intermediate transfer belt 8. With this structure, the toner on the intermediate transfer belt 8 passing through the pre-cleaning brush roller 101 is aligned with a negative polarity by the polarity control unit, and is conveyed to the normally charged toner cleaning brush roller 107 provided downstream of the polarity control unit in the belt movement direction. Subsequently, the normally charged toner cleaning brush roller 107 removes the toner having a negative polarity. A section for injecting charges having a negative polarity into the toner on the intermediate transfer belt 8 in the polarity control unit may be conductive brushes, conductive blades, corona chargers, etc. The charged polarity of the toner may not be aligned with a negative polarity but aligned with a positive polarity. Then, a reversely charged toner cleaning brush roller applied with a voltage having a negative polarity may be arranged downstream of the polarity control unit in the belt movement direction and remove the toner aligned with a positive polarity on the intermediate belt. With such structure, the pre-cleaning brush roller 101 roughly removes the toner of the untransferred toner images from the intermediate transfer belt 8 as well, and thus, the toner amount conveyed to the polarity control unit decreases. Accordingly, the polarity control unit can favorably align the polarity of the toner on the intermediate transfer belt 8 with one of the polarities. As a result, the cleaning brush roller arranged downstream of the polarity control unit can favorably electrostatically remove the toner on the intermediate transfer belt 8. Therefore, even when the untransferred toner images to which a large amount of the toner is adhered enter the belt cleaning device 100, the toner images can be favorably removed. The surface roughness Ra of the recovery roller of the cleaning unit provided downstream of the polarity control unit is set to be smaller than the surface roughness of the pre-recovery roller, and the linear pressure of the scraping blade against the recovery roller of the cleaning unit provided downstream of the polarity control unit is set to be smaller than the linear pressure of the pre-scraping blade against the pre-recovery roller. Thus, the fixing of the toner to the scraping blade of the cleaning unit provided downstream of the polarity control unit can be inhibited.

In the belt cleaning device 100 of the present embodiment, voltages are applied to each of the recovery rollers 102, 105, and 108 and the cleaning brush rollers 101, 104, and 107. However, the recovery rollers 102, 105, and 108 may be structured to be metal rollers, and voltages may be applied only to the recovery rollers. With this structure, a bias voltage a little smaller than the bias voltage applied to the recovery roller is applied to the cleaning brush roller via the contact portion with the recovery roller by electric potential drop due to the fiber resistance of the cleaning brush roller. Thus, electric potential difference is formed between the recovery roller and the cleaning brush roller. Therefore, the toner can be electrostatically moved to the recovery roller from the cleaning brush roller due to the electric potential gradient in the recovery roller direction.

The toner suitably used in the printer of the present embodiment is described below.

The toner suitably used in the printer of the present embodiment preferably has a mean volume diameter of 3 micrometers to 6 micrometers in order to reproduce fine dots that are equal to or more than 600 dpi. The toner preferably has a ratio (Dv/Dn) of a volume mean diameter (Dv) and a number mean diameter (Dn) in a range of 1.00 to 1.40. The particle size distribution becomes sharp as (Dv/Dn) is close to 1.00. The use of such toner having small particle sizes and small particle size distribution forms uniform charge amount distribution of the toner, enables the production of high quality images almost free from a texture fog, and enables a high transfer rate in an electrostatic transfer system.

Figure 12:
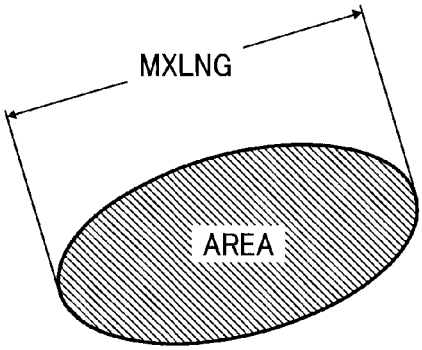
FIG. 12 is a schematic diagram for explaining the maximum diameter MXLNG and the plane area AREA of the projection image of toner particles on a two-dimensional plane.

The shape factor SF-1 of the toner is preferably in a range of 100 to 150, and the shape factor SF-2 of the toner is preferably in a range of 100 to 180. FIG. 12 is a diagram schematically illustrating the shape of the toner for explaining the shape factor SF-1. The shape factor SF-1 indicates the degree of the roundness of the toner shape and is represented by the following formula (1). SF-1 is obtained by dividing the square of the maximum length MXLNG of the shape produced by projecting the toner onto a two-dimensional plane by a figure area AREA and by multiplying the result by $100\pi/4$.

$$SF\text{-}1=\{(MXLNG)^2/AREA\}\times(100\pi)/4 \quad (1)$$

When the value of SF-1 is 100, the shape of the toner is a spherical, while the shape becomes indefinite in accordance with the increase in the value of SF-1.

Figure 13:
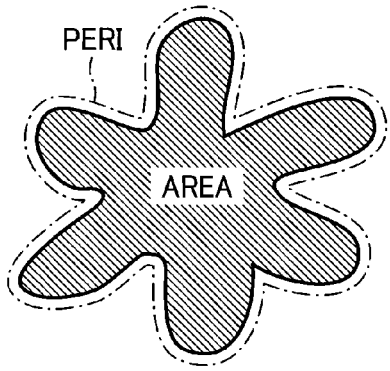
FIG. 13 is a schematic diagram for explaining the peripheral length PERI and the plane area AREA of the projection image of toner particles on a two-dimensional plane.

FIG. 13 is a diagram schematically illustrating the shape of the toner for explaining the shape factor SF-2. The shape factor SF-2 indicates the degree of the projections and depressions of the toner shape and is represented by the following formula (2). SF-2 is obtained by dividing the square of the peripheral length PERI of the figure produced by projecting the toner onto a two-dimensional plane by a figure area AREA and by multiplying the result by $100\pi/4$.

$$SF\text{-}2=\{(PERI)^2/AREA\}\times 100/(4\pi) \quad (2)$$

When the value of SF-2 is 100, the projections and depressions disappear from the surface of the toner, while the projections and depressions on the surface of the toner become prominent in accordance with the increase in the value of SF-2.

The shape factor is measured, specifically, by taking a picture of the toner using a scanning electron microscope (S-800; manufactured by Hitachi, Ltd.), by introducing the picture into an image analyzer (LUSEX3; manufactured by Nireco Corporation) to analyze it, and by calculating the result. When the shape of the toner is close to a sphere, the contact state between the toners or the toner and the photosensitive element becomes point contact. Thus, the adsorbability between the toners decreases to increase the fluidity, and the adsorbability between the toner and the photosensitive element decreases to increase the transfer rate. When the shape factor SF-1 exceeds 150 and the shape factor SF-2 exceeds 180, the transfer rate decreases, which is not preferred.

The toner suitably used for a color printer is a toner obtained by subjecting a toner material liquid including at least a polyester prepolymer having a functional group containing a nitrogen atom, a polyester, a colorant, and a release agent that are dispersed in an organic solvent to any one of cross-linking and an elongation reaction or both in a water-based solvent. The constituent materials and the production method of the toner are described below.

Polyester

Polyester is obtained by a polycondensation reaction between polyhydric alcohol compounds and polycarboxylic acid compounds.

Examples of the polyhydric alcohol compounds (PO) include dihydric alcohols (DIO) and trivalent or more polyhydric alcohols (TO), and preferably, (DIO) alone, or a mixture of (DIO) with a small amount of (TO). Examples of the dihydric alcohols (DIO) include alkylene glycol (such as ethylene glycol, 1,2-propylene glycol, 1,3-propylene glycol, 1,4-butanediol, and 1,6-hexanediol), alkylene ether glycols (such as diethylene glycol, triethylene glycol, dipropylene glycol, polyethylene glycol, polypropylene glycol, and polytetramethylene ether glycol), alicyclic diols (such as 1,4-cyclohexane dimethanol and hydrogenated bisphenol A), bisphenols (such as bisphenol A, bisphenol F, and bisphenol S), adducts of alkylene oxides (such as ethylene oxide, propylene oxide, and butylene oxide) with the alicyclic diols, and adducts of alkylene oxides (such as ethylene oxide, propylene oxide, and butylene oxide) with the bisphenols. Among these, alkylene glycol having a carbon number from 2 to 12 and adducts of alkylene oxides with the bisphenols are preferable. Particularly preferable are adducts of alkylene oxides with the bisphenols, and a combination of adducts of alkylene oxides with the bisphenols and alkylene glycol having a carbon number from 2 to 12. Examples of the trivalent or more polyhydric alcohols (TO) include trihydric to octahydric or more polyhydric aliphatic alcohols (such as glycerol, trimethylolethane, trimethylolpropane, pentaerythritol, and sorbitol), trivalent or more phenols (such as trisphenol PA, phenol novolac, and cresol novolac), and adducts of alkylene oxides with the trivalent or more polyphenols.

Examples of the polycarboxylic acids (PC) include dicarboxylic acids (DIC) and trivalent or more polycarboxylic acids (TC), and preferably, (DIC) alone and a mixture of (DIC) with a small amount of (TC). Examples of the dicarboxylic acids (DIC) include alkylene dicarboxylic acids (such as succinic acid, adipic acid, and sebacic acid), alkenylene dicarboxylic acids (such as maleic acid and fumaric acid), and aromatic dicarboxylic acids (such as phthalic acid, isophthalic acid, terephthalic acid, and naphthalene dicarboxylic acid). Among these, the alkenylene dicarboxylic acids having a carbon number from 4 to 20 and the aromatic dicarboxylic acids having a carbon number from 8 to 20 are preferred. Examples of the trivalent or more polycarboxylic acids (TC) include aromatic polycarboxylic acids having a carbon number from 9 to 20 (such as trimellitic acid and pyromellitic acid). The polycarboxylic acids (PC) may be reacted with the polyhydric alcohols (PO) using acid anhydrides or lower alkyl esters (such as methyl ester, ethyl ester, and isopropyl ester) of the polycarboxylic acids (PC) described above.

A ratio between the polyhydric alcohols (PO) and the polycarboxylic acids (PC) is typically, from 2/1 to 1/1, preferably, from 1.5/1 to 1/1, and more preferably, from 1.3/1 to 1.02/1, as an equivalent ratio of [OH]/[COOH] between a hydroxy group [OH] and a carboxy group [COOH]. The polycondensation reaction between the polyhydric alcohol (PO) and the polycarboxylic acid (PC) is performed by applying heat at 150 degrees Celsius to 180 degrees Celsius under the presence of a known esterification catalyst, such as tetrabutoxy titanate and dibutyltin oxide, and by distilling off produced water while the pressure is reduced as required. Thus, a hydroxy group-containing polyester is produced. The number of hydroxy groups of the polyester is preferably 5 or more. The acid number of the polyester is generally, 1 to 30, and preferably, 5 to 20. With the acid number, the polyester is easily charged to a negative polarity and has an excellent affinity of the toner for a recording sheet at the time of fixing it to the recording sheet to improve the low-temperature fixability. However, when the acid number exceeds 30, the charge stability tends to be lowered, especially due to an environmental fluctuation. The weight average molecular weight is 10,000 to 400,000, and preferably, 20,000 to 200,000. When the weight average molecular weight is less than 10,000, the offset resistance deteriorates, which is not preferred. In contrast, when the weight average molecular weight exceeds 400,000, the low-temperature fixability deteriorates, which is not preferred.

Examples of the polyester include, besides the unmodified polyester obtained by the polycondensation reaction as described above, preferably, a urea modified polyester. The urea modified polyester is obtained in the following manner. Carboxy groups, hydroxy groups, etc. at the end of the polyester obtained by the polycondensation reaction are reacted with a polyisocyanate compound (PIC) to obtain an isocyanate group-containing polyester prepolymer (A), the obtained polyester prepolymer (A) is reacted with amines, and thus, the molecular chains are subjected to any one of cross-linking and an elongation reaction or both. Examples of the polyisocyanate compounds (PIC) include aliphatic polyisocyanates (such as tetramethylene diisocyanate, hexamethylene diisocyanate, and 2,6-isocyanate methyl caproate), alicyclic polyisocyanates (such as isophorone diisocyanate and cyclohexylmethane diisocyanate), aromatic diisocyanates (such as tolylene diisocyanate and diphenylmethane diisocyanate), aromatic aliphatic diisocyanates (such as $\alpha,\alpha,\alpha',\alpha'$-tetramethylxylylene diisocyanate), isocyanates, compounds formed by blocking these polyisocyanates by phenol derivatives, oximes, and caprolactams, and a combination of at least two of these. A ratio of the polyisocyanate compound (PIC) is typically, from 5/1 to 1/1, preferably, from 4/1 to 1.2/1, and more preferably, from 2.5/1 to 1.5/1, as an equivalent ratio of [NCO]/[OH] between an isocyanate group [NCO] and a hydroxy group [OH] of a hydroxy group-containing polyester. When [NCO]/[OH] exceeds 5/1, the low-temperature fixability deteriorates. In the use of a urea-modified polyester, the urea content in the ester becomes low when a molar ratio of [NCO] is less than 1/1, and the hot offset resistance deteriorates. The content of the polyisocyanate compound (PIC) constituent in the isocyanate group-containing polyester prepolymer (A) is typically, 0.5 percent by weight to 40 percent by weight, preferably, 1 percent by weight to 30 percent by weight, and more preferably, 2 percent by weight to 20 percent by weight. When the content of the polyisocyanate compound is less than 0.5 percent by weight, the hot offset resistance deteriorates, which is unfavorable from the viewpoint of compatibility of heat resistant preservability and a low-temperature fixability. In contrast, when the content of the polyisocyanate compound exceeds 40 percent by weight, the low-temperature fixability deteriorates. The number of isocyanate groups contained in one molecule of the isocyanate group-containing polyester prepolymer (A) is typically, at least 1, preferably, an average of 1.5 to 3, and more preferably, an average of 1.8 to 2.5. When the isocyanate group per molecule is less than 1, the molecular weight of the urea-modified polyester becomes low, and the hot offset resistance deteriorates.

Examples of the amines (B) to be reacted with the polyester prepolymer (A) include divalent amine compounds (B1), trivalent or more polyvalent amine compounds (B2), amino alcohols (B3), amino mercaptans (B4), amino acids (B5), and compounds (B6) formed by blocking amino groups of B1 to B5.

Examples of the divalent amine compounds (B1) include aromatic diamines (such as phenylene diamine, diethyl toluene diamine, and 4,4'-diaminodiphenyl methane), alicyclic diamines (such as 4,4'-diamino-3,3'-dimethyldicyclohexylmethane, diamine cyclohexane, and isophorone diamine), and aliphatic diamines (such as ethylene diamine, tetramethylene diamine, and hexamethylene diamine). Examples of the trivalent or more polyvalent amine compounds (B2) include diethylene triamine and triethylene tetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6) formed by blocking amino groups of B1 to B5 include ketimine compounds obtained from the amines of B1 to B5 and ketones (such as acetone, methyl ethyl ketone, and methyl isobutyl ketone), and oxazolidine compounds. The preferable amines among the amines (B) are B1 and a mixture of B1 with a small amount of B2.

A ratio of the amines (B) is typically, 1/2 to 2/1, preferably, 1.5/1 to 1/1.5, and more preferably, 1.2/1 to 1/1.2 as an equivalent ratio of [NCO]/[NHx] between an isocyanate group [NCO] in the isocyanate group-containing polyester prepolymer (A) and an amine group [NHx] in the amines (B). When [NCO]/[NHx] exceeds 2/1 or is less than ½, the molecular weight of the urea-modified polyester becomes smaller, and the hot offset resistance deteriorates.

The urea-modified polyester may contain urethane bonds together with urea bonds. A molar ratio of the urea bond content and the urethane bond content is typically, 100/0 to 10/90, preferably, 80/20 to 20/80, and more preferably, 60/40 to 30/70. When the molar ratio of the urea bond is less than 10 percent, the hot offset resistance deteriorates.

The urea-modified polyester is manufactured by, for example, a one-shot method. A polyhydric alcohol (PO) and a polycarboxylic acid (PC) is heated to 150 degrees Celsius to 280 degrees Celsius in the presence of a known esterification catalyst such as tetrabutoxytitanate and dibutyltin oxide, and produced water is distilled off while the pressure is reduced as required to obtain a hydroxy group-containing polyester. Subsequently, a polyisocyanate (PIC) is reacted with the obtained polyester at a temperature of 40 degrees Celsius to 140 degrees Celsius to obtain an isocyanate group-containing polyester prepolymer (A). Amines (B) is further reacted with the obtained (A) at a temperature of 0 degrees Celsius to 140 degrees Celsius to obtain a urea-modified polyester.

During the reaction of (PIC) with the polyester and the reaction of (A) with (B), a solvent can be used as necessary. Examples of the solvent available include solvents inactive to polyisocyanates (PIC), for example, aromatic solvents (such as toluene and xylene), ketones (such as acetone, methyl ethyl ketone, and methyl isobutyl ketone), esters (such as ethyl acetate), amides (such as dimethylformamide and dimethylacetamide), and ethers (such as tetrahydrofuran).

A reaction terminator can be used as required for any one of cross-linking and an elongation reaction or both between the polyester prepolymer (A) and the amines (B), and thus, the molecular weight of the urea-modified polyester obtained can be adjusted. Examples of the reaction terminator include monoamines (such as diethylamine, dibutylamine, butylamine, and laurylamine), and compounds (ketimine compounds) obtained by blocking the monoamines.

The weight average molecular weight of the urea-modified polyester is typically, equal to or more than 10,000, preferably, 20,000 to 10,000,000, and more preferably, 30,000 to 1,000,000. When the weight average molecular weight is less than 10,000, the hot offset resistance deteriorates. A number average molecular weight of the urea-modified polyester or the like is not particularly limited when the unmodified polyester described above is used, and the number average molecular weight may be one that is easily obtained to get the weight-average molecular weight. When the urea-modified polyester is used alone, the number average molecular weight is typically, 2000 to 15,000, preferably, 2000 to 10,000, and more preferably, 2000 to 8000. When the number average molecular weight exceeds 20,000, the low-temperature fixability deteriorates, and the glossiness when the polyester is used for full-color image forming apparatuses also deteriorates.

By using the urea-modified polyester in combination with the unmodified polyester, both the low-temperature fixability and the glossiness when they are used for full-color image forming apparatuses are improved, which is more preferable than a single use of the urea-modified polyester. The unmodified polyester may include modified polyesters modified by chemical bonds other than urea bonds.

It is preferable that at least parts of the unmodified polyester and the urea-modified polyester be compatible with each other, from viewpoint of low-temperature fixability and hot offset resistance. Therefore, the compositions of the unmodified polyester and the urea-modified polyester are preferably similar to each other.

A weight ratio between the unmodified polyester and the urea-modified polyester is typically, 20/80 to 95/5, preferably, 70/30 to 95/5, more preferably, 75/25 to 95/5, and particularly preferably, 80/20 to 93/7. When the weight ratio of the urea-modified polyester is less than 5 percent, the hot offset resistance deteriorates, which is unfavorable from the viewpoint of compatibility of heat resistant preservability and a low-temperature fixability.

A glass transition point (Tg) of binder resins containing the unmodified polyester and the urea-modified polyester is typically, 45 degrees Celsius to 65 degrees Celsius and preferably, 45 degrees Celsius to 60 degrees Celsius. When Tg is less than 45 degrees Celsius, the heat resistance of the toner deteriorates, but when Tg exceeds 65 degrees Celsius, the low temperature fixability becomes insufficient.

The urea-modified polyester is apt to exist at the surface of toner base particles to be obtained and thus tends to have favorable heat resistant preservability as compared with known polyester toners even when the glass transition point is low.

Colorant

All known dyes and pigments are available for the colorant. Examples of the colorant include carbon black, nigrosine dyes, iron black, naphthol yellow S, hansa yellow (10G, 5G, and G), cadmium yellow, yellow iron oxide, yellow ocher, chrome yellow, titanium yellow, polyazo yellow, oil yellow, hansa yellow (GR1, RN, and R), pigment yellow L, benzidine yellow (G and GR), permanent yellow (NCG), vulcan fast yellow (5G and R), tartrazine lake, quinoline yellow lake, anthrazane yellow BGL, isoindolinone yellow, red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, and F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine blue, Prussian blue, anthraquinone blue, fast violet B, methyl violet lake, cobalt violet, manganese violet, dioxane violet, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, lithopone, and mixtures thereof. The content of the colorant in the toner is typically, 1 percent to 15 percent by weight, and preferably, 3 percent to 10 percent by weight.

The colorant can also be used as a masterbatch mixed with resins. Examples of binder resins that are used for manufacturing the masterbatch or that are kneaded with the masterbatch include: polymers of styrenes and the substitution product of the styrenes, such as polystyrene, poly-p-chlorostyrene, and polyvinyltoluene, or copolymers of these compounds and vinyl compounds, polymethyl methacrylate, polybutyl methacrylate, polyvinyl chloride, polyvinyl acetate, polyethylene, polypropylene, polyesters, epoxy resins, epoxy polyol resins, polyurethane, polyamides, polyvinyl butyral, polyacrylate resins, rosin, modified rosin, terpene resins, aliphatic or alicyclic hydrocarbon resins, aromatic petroleum resins, chlorinated paraffin, and paraffin wax. These materials can be used alone or as a mixture thereof.

Charge Control Agent

Known charge control agents can be used as a charge control agent. Examples of the charge control agent include nigrosine dyes, triphenylmethane dyes, chromium-containing metal complex dyes, chelate molybdate pigments, rhodamine dyes, alkoxy amines, quaternary ammonium salts (including fluorine modified quaternary ammonium salts), alkylamides, phosphorus alone or compounds thereof, tungsten alone or compounds thereof, fluorine-based active agents, salicylic acid metal salts, and metal salts of salicylic acid derivatives. Specific examples of the charge control agent include Bontron 03 as nigrosine dyes, Bontron P-51 as quaternary ammonium salts, Bontron S-34 as metal-containing azo dyes, E-82 as oxynaphthoic acid metal complexes, E-84 as salicylic acid metal complexes, E-89 as phenol condensates (these are manufactured by Orient Chemical Industries Co., Ltd.), TP-302 and TP-415 as quaternary ammonium salt molybdenum complexes (manufactured by Hodogaya Chemical Industries Co., Ltd.), Copy Charge PSY VP2038 as quaternary ammonium salts, Copy Blue PR as triphenyl methane derivatives, and Copy Charge NEG VP2036 and Copy Charge NX VP434 as quaternary ammonium salts (these are manufactured by Hoechst AG), LR1-901, and LR-147 as boron complexes (manufactured by Japan Carlit Co., Ltd.), copper phthalocyanine, perylene, quinacridone, azo pigments, and polymer compounds having a functional group such as a sulfonic acid group, a carboxy group, and a quaternary ammonium salt group. Among these, particularly, a material that controls the toner to have a negative polarity is preferably used.

The amount of the charge control agent to be used is determined depending on the type of binder resins, presence or absence of additives to be used as required, and a method of manufacturing toner including a dispersion method, and thus is not uniquely limited. However, the charge control agent is used preferably, in a range from 0.1 part by weight to 10 parts by weight, and more preferably, from 0.2 part by weight to 5 parts by weight, per 100 parts by weight of the binder resin. When the amount exceeds 10 parts by weight, the chargeability of the toner is too large, which decreases effects of the charge control agent. As a result, electrostatic attracting force with a developing roller increases, fluidity of the developer decreases, and the image density decreases.

Release Agent

A wax having a low melting point of 50 degrees Celsius to 120 degrees Celsius effectively functions as a release agent at the interface between a fixing roller and a toner particularly when dispersed in a binder resin. This improves the high temperature offset without the application of a release agent as oil to the fixing roller. Such wax components include the followings. Examples of the waxes include plant-derived waxes such as carnauba wax, cotton wax, wood wax, and rice wax, animal-derived waxes such as beeswax and lanolin, mineral-based waxes such as ozokerite and ceresin, and petroleum waxes such as paraffin, microcrystalline, and petrolatum. Examples of the waxes include, besides these natural waxes, synthetic hydrocarbon waxes such as Fischer-Tropsch wax and polyethylene wax, and synthetic waxes such as esters, ketones, and ethers. Moreover, examples of the waxes include the crystalline polymer, for example: fatty acid amides such as 12-hydroxystearic acid amide, stearic acid amide, phthalic anhydride imide, and chlorinated hydrocarbons; and as low-molecular weight crystalline polymer resins, crystalline polymers having a long alkyl group at the side chain, such as homopolymers or copolymers (for example, the copolymer of n-stearyl acrylate-ethyl methacrylate) of a polyacrylate such as poly n-stearyl methacrylate and poly n-lauryl methacrylate.

The charge control agent and the release agent can be fused and mixed with the masterbatch and the binder resin, and may also be added to an organic solvent at a time of dissolution and dispersion.

External Additive

Inorganic fine particles are preferably used as an external additive for facilitating the fluidity, developing performance, and chargeability of toner particles. The inorganic fine particles have a primary particle size of, preferably, $5\times10^{-3}$ *to* 2 micrometer and particularly preferably, $5\times10^{-3}$ *to* 0.5 micrometer. A specific surface area measured by a BET method is preferably 20 $m^2/g$ to 500 $m^2/g$. The use ratio of the inorganic fine particles in the toner is preferably, 0.01 percent by weight to 5 percent by weight, and particularly preferably, 0.01 percent by weight to 2.0 percent by weight. Specific examples of the inorganic fine particles include silica, alumina, titanium oxides, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, hydrophobic silica fine particles and hydrophobic titanium oxide fine particles are preferably used in combination as a fluidizing agent. In particular, when both of the fine particles having an average diameter of equal to or less than 5×10-4 micrometer are stirred to be mixed, electrostatic force and Van der Waals force with the toner are significantly improved. As a result, even when such external additives are stirred and mixed with the toner in a developing device to achieve a desired charge level, favorable image quality having no void or other abnormal images can be obtained without desorption of the fluidizing agent from the toner, and further the amount of the toner left untransferred can be reduced. Titanium oxide fine particles are excellent in environmental stability and image density stability, but tend to deteriorate charge rising properties. Therefore, when an addition amount of titanium oxide fine particles is larger than that of silica fine particles, this adverse effect may be more influential. However, when the addition amounts of hydrophobic silica fine particles and hydrophobic titanium oxide fine particles are within a range of 0.3 percent by weight to 1.5 percent by weight, desired charge rising properties can be obtained without significant damage to the charge rising properties. In other words, even when images are repeatedly copied, stable image quality can be obtained.

A method of manufacturing a toner is described below. Exemplary embodiments of the method of manufacturing a toner are explained below, but the present invention is not limited to these embodiments.

Method of Manufacturing Toner (1) A toner material solution is produced by dispersing a colorant, an unmodified polyester, an isocyanate group-containing polyester prepolymer, and a release agent in an organic solvent.

From the viewpoint of easy removal after formation of toner base particles, it is preferable that the organic solvent be volatile and have a boiling point of less than 100 degrees Celsius. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Theses solvents can be used alone or in combination of two or more types thereof. In particular, aromatic solvents such as toluene and xylene, and halogenated hydrocarbons such as methylene chloride, 1,2-dichloroethane, chloroform, and carbon tetrachloride are preferred. The amount of the organic solvent to be used is typically, 0 part by weight to 300 parts by weight, preferably, 0 part by weight to 100 parts by weight, and further preferably, 25 parts by weight to 70 parts by weight per 100 parts by weight of the polyester prepolymer.

(2) The toner material solution is emulsified in an aqueous medium in the presence of a surfactant and resin fine particles.

Such aqueous medium may be water alone or contain organic solvents such as alcohols (methanol, isopropyl alcohol, ethylene glycol, etc.), dimethyl formamide, tetrahydrofuran, cellosolves (e.g. methyl cellosolve), and lower ketones (acetone, methylethylketone, etc).

The amount of the aqueous medium to be used for 100 parts by weight of the toner material solution is typically, 50 parts by weight to 2000 parts by weight, and preferably, 100 parts by weight to 1000 parts by weight. When the amount is less than 50 parts by weight, the toner material solution is poorly dispersed, and thus, toner particles having a predetermined particle size cannot be obtained. In contrast, when the amount exceeds 20,000 parts by weight, this is economically inefficient.

To improve the dispersion in the aqueous medium, a dispersing agent such as a surfactant and resin fine particles is added as required.

Examples of the surfactant include: anionic surfactants such as alkyl benzene sulfonate, α-olefin sulfonate, and ester phosphate; cationic surfactants of amine salt types such as alkyl amine salts, aminoalcohol fatty acid derivatives, polyamine fatty acid derivatives, and imidazoline, and of quaternary ammonium salt types such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohol derivatives; and ampholytic surfactants such as alanine, dodecyl di(aminoethyl)glycine, di(octylaminoethyl)glycine, and N-alkyl-N,N-dimethyl ammonium betaine.

The use of a surfactant having a fluoroalkyl group can achieve a desired effect with a very small amount thereof. Preferable examples of anionic surfactants having a fluoroalkyl group include fluoroalkyl carboxylic acids having a carbon number from 2 to 10 and the corresponding metal salts, disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and the corresponding metal salts, perfluoroalkyl carboxylic acid (C7 to C13) and the corresponding metal salts, perfluoroalkyl (C4 to C12) sulfonic acid and the corresponding metal salts, perfluorooctane sulfonic acid diethanolamide, N-propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethylsulfonyl glycine salts, and monoperfluoroalkyl (C6 to C16) ethyl phosphoric acid esters.

Examples of trade names thereof include SURFLON S-111, S-112, and S-113 (manufactured by Asahi Glass Co., Ltd.), FLUORAD FC-93, FC-95, FC-98, and FC-129 (manufactured by Sumitomo 3M Limited), UNIDYNE DS-101 and DS-102 (manufactured by Daikin Industries, Ltd.), MEGAFACE F-110, F-120, F-113, F-191, F-812, and F-833 (manufactured by Dainippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by Neos Company Limited).

Examples of the cationic surfactants include aliphatic primary, secondary, or secondary amine acids containing a fluoroalkyl group, aliphatic quaternary ammonium salts such as ammonium salts of perfluoroalkyl (C6-C10) sulfonamide propyl trimethyl, benzalkonium salts, benzethonium chloride, pyridinium salts, and imidazolinium salts. Examples of the trade names thereof include SURFLON S-121 (manufactured by Asahi Glass Co., Ltd.), FLUORAD FC-135 (manufactured by Sumitomo 3M Limited), UNIDYNE DS-202 (manufactured by Daikin Industries, Ltd.), MEGAFACE F-150 and F-824 (manufactured by Dainippon Ink & Chemicals, Inc.), EKTOP EF-132 (manufactured by Tochem Products Co., Ltd.), and FTERGENT F-300 (manufactured by Neos Company Limited).

The resin fine particles are added for stabilizing the toner base particles that are formed in the aqueous solvent. To stabilize the toner base particles, the resin fine particles are preferably added such that a surface coverage of the resin fine particles on the surface of the toner base particles is in a range of 10 percent to 90 percent. Examples of the resin fine particles include methyl polymethacrylate fine particles of 1 micrometer and 3 micrometers, polystyrene fine particles of 0.5 micrometer and 2 micrometers, and poly(styrene-acrylonitrile) fine particles of 1 micrometer. Examples of the trade names thereof include PB-200H (manufactured by Kao Corporation), SGP (manufactured by Soken Chemical & Engineering Co., Ltd.), Technopolymer-SB (manufactured by SEKISUI PLASTICS CO., Ltd.), SGP-3G (manufactured by Soken Chemical & Engineering Co., Ltd.), and Micropearl (manufactured by SEKISUI CHEMICAL CO., LTD.) etc. Furthermore, inorganic compound dispersing agents such as tricalcium phosphate, calcium carbonate, titanium oxide, colloidal silica, and hydroxyapatite can also be used.

Dispersion droplets may be stabilized by a polymer protective colloid as a dispersing agent usable in combination with the resin fine particles and the inorganic dispersing agent. Examples of the dispersing agent include homopolymers or copolymers of: acids such as acrylic acid, methacrylic acid, α-cyanoacrylic acid, α-cyanomethacrylic acid, itaconic acid, crotonic acid, fumaric acid, maleic acid, or maleic anhydride; or (meth)acrylic monomers containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide, and N-methylol methacrylamide; vinyl alcohol or ethers with vinyl alcohol, such as vinyl methyl ether, vinyl ethyl ether, and vinyl propyl ether; esters of vinyl alcohols and compounds containing carboxyl groups, such as vinyl acetate, vinyl propionate, and vinyl butyrate; acrylamide, methacrylamide, and diacetone acrylamide, or their methylol compounds; acid chlorides such as chloride acrylate and chloride methacrylate; nitrogen-containing compounds such as vinylpyridine, vinylpyrrolidone, vinylimidazole, and ethyleneimine, or compounds having the heterocyclic ring of the nitrogen-containing compounds; and other compounds. Moreover, examples of the dispersing agent include polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ethers, polyoxyethylene lauryl phenyl ethers, polyoxyethylene stearyl phenyl esters, and polyoxyethylene nonyl phenyl esters; and celluloses such as methyl cellulose, hydroxyethyl cellulose, and hydroxypropyl cellulose.

A dispersion method is not particularly limited, and it is possible to use known facilities of a low-speed shearing type, a high-speed shearing type, a friction type, a high-pressure jet type, and an ultrasonic type. Among these, the high-speed shearing type is preferred to obtain dispersed particles having a particle size of 2 micrometers to 20 micrometers. When a high-speed shearing type dispersing machine is used, the number of revolutions is not particularly limited and is typically, 1000 rpm to 30,000 rpm, and preferably, 5000 rpm to 20,000 rpm. The dispersion time is not particularly limited and is typically 0.1 minute to 5 minutes in a batch system. The dispersing temperature is typically, 0 degree Celsius to 150 degrees Celsius (under pressure), and preferably, 40 degrees Celsius to 98 degrees Celsius.

(3) During preparation of an emulsified liquid, amines (B) are added thereto and are allowed to react with an isocyanate group-containing polyester prepolymer (A).

This reaction accompanies any one of cross-linking and an elongation reaction or both of the molecular chains. The reaction time is selected according to the reactivity between the isocyanate group structure of the polyester prepolymer (A) and the amines (B) and is typically, 10 minutes to 40 hours, and preferably, 2 hours to 24 hours. The reaction temperature is typically, 0 degree Celsius to 150 degrees Celsius, and preferably, 40 degrees Celsius to 98 degrees Celsius. A known catalyst can be used as necessary. Specific examples of the catalyst include dibutyltin laurate and dioctyltin laurate.

(4) After the completion of the reaction, the organic solvent is removed from the resultant emulsified dispersion (reactant), and the resultant substance is washed and dried to obtain toner base particles.

To remove the organic solvent therefrom, the whole system is gradually heated up in a stirred state of laminar flow and is stirred vigorously at a fixed temperature range. Subsequently, the solvent is removed from the dispersion, and then, spindle-shaped toner base particles are prepared. When a compound like a calcium phosphate salt that can dissolve in an acid or an alkali is used as a dispersion stabilizer, after the calcium phosphate salt is dissolved in an acid such as hydrochloric acid, the calcium phosphate salt is removed from the toner base particles by a method of washing with water or other methods. In addition, the calcium phosphate salt can also be removed through decomposition by an enzyme or other operations.

(5) A charge control agent is implanted into the toner base particles thus obtained, and inorganic fine particles such as silica fine particles and titanium oxide fine particles are externally added to obtain a toner. The implantation of the charge control agent and the external addition of the inorganic fine particles are carried out by a known method using a mixer or the like.

Accordingly, the toner having a small particle size and a sharp particle-size distribution can be obtained readily. Moreover, by vigorously stirring the toner in the process of removing the organic solvent, the shape of the particles can be controlled in a range from a spherical shape to a spindle shape. Furthermore, the surface morphology can also be controlled in a range from a smooth shape to a rough shape.

Figure 14A:
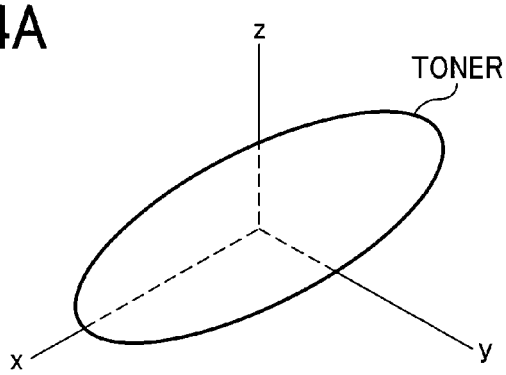
FIGS. 14A, 14B, and 14C are each a schematic of the shape of a toner.
Figure 14B:
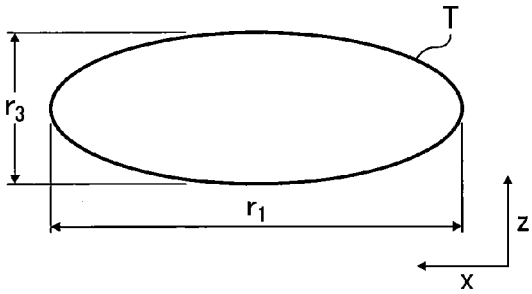
Figure 14C:
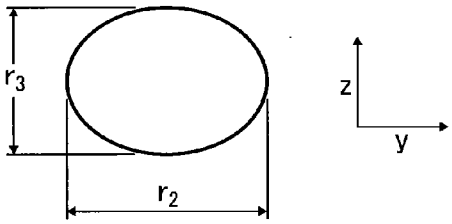

The shape of the toner is substantially spherical and can be represented by the following shape requirements. FIGS. 14A, 14B, and 14C are each a schematic of the shape of the toner. In FIGS. 14A, 14B, and 14C, the substantial spherical toner is defined by a major axis $r_1$, a minor axis $r_2$, and a thickness $r_3$ (where $r_1 \geqq r_2 \geqq r_3$). The toner preferably has a ratio $(r_2/r_1)$ of the major axis and the minor axis (see FIG. 14B) of 0.5 to 1.0 and has a ratio $(r_3/r_2)$ of the thickness and the minor axis (see FIG. 14C) of 0.7 to 1.0. When the ratio $(r_2/r_1)$ of the major axis and the minor axis is less than 0.5, the shape departs from spherical. Therefore, the dot reproducibility and the transfer efficiency deteriorate, and it becomes impossible to produce high image quality. When the ratio $(r_3/r_2)$ of the thickness and the minor axis is less than 0.7, the shape gets close to flat. As a result, it becomes impossible to obtain a high transfer rate like the transfer rate of a spherical toner. When the ratio $(r_3/r_2)$ of the thickness and the minor axis is 1.0 in particular, the toner particle becomes a rotating body whose major axis serves as a rotation axis, which can improve the fluidity of the toner.

$r_1$, $r_2$, and $r_3$ are measured by taking pictures from different viewing angles using scanning electron microscope (SEM) and by observing them.

The confirmatory experiment of the cleaning device of an embodiment of the present invention is described below.

Confirmatory Experiment

In the belt cleaning device illustrated in FIG. 4, Embodiment and Comparative Embodiment are made to have different linear pressures of the scraping blades against the recovery rollers and different surface roughness Ra of the recovery rollers of the pre-cleaning unit 100*a*, the reversely charged toner cleaning unit 100*b*, and the normally charged toner cleaning unit 100*c*, from each other. Thus, paper-feeding experiments are performed. Four hundred thousand paper sheets are fed in a paper-feeding condition of a paper size of A4 and an image area ratio of 5 percent. In this process, a refreshing mode for a developer is set between the paper sheets, and the belt cleaning device contains a toner having a density of M/A=1.1 mg/cm$^2$.

Embodiments

Surface Roughness of Each Recovery Roller

Surface roughness Ra of the pre-recovery roller 102: 1.6

Surface roughness Ra of the reversely charged toner recovery roller 105: 0.4

Surface roughness Ra of the normally charged toner recovery roller 108: 0.8

Linear Pressure of Each Scraping Blade Against Recovery Roller

Blade linear pressure against pre-recovery roller: 69 gf/cm

Blade linear pressure against reversely charged toner recovery roller: 32 gf/cm

Blade linear pressure against normally charged toner recovery roller: 46 gf/cm

Comparative Embodiment

Surface Roughness of Each Recovery Roller

Surface roughness Ra of the pre-recovery roller 102: 0.8

Surface roughness Ra of the reversely charged toner recovery roller 105: 0.8

Surface roughness Ra of the normally charged toner recovery roller 108: 0.8

Linear Pressure of Each Scraping Blade Against Recovery Roller

Blade linear pressure against pre-recovery roller: 46 gf/cm

Blade linear pressure against reversely charged toner recovery roller: 46 gf/cm

Blade linear pressure against normally charged toner recovery roller: 46 gf/cm

As a result of the confirmatory experiment with the conditions described above, it is confirmed that no cleaning failure occurred to the end in the condition of Embodiment, but that cleaning failure occurred in the middle of the experiment in the condition of Comparative Example.

Figure 15:
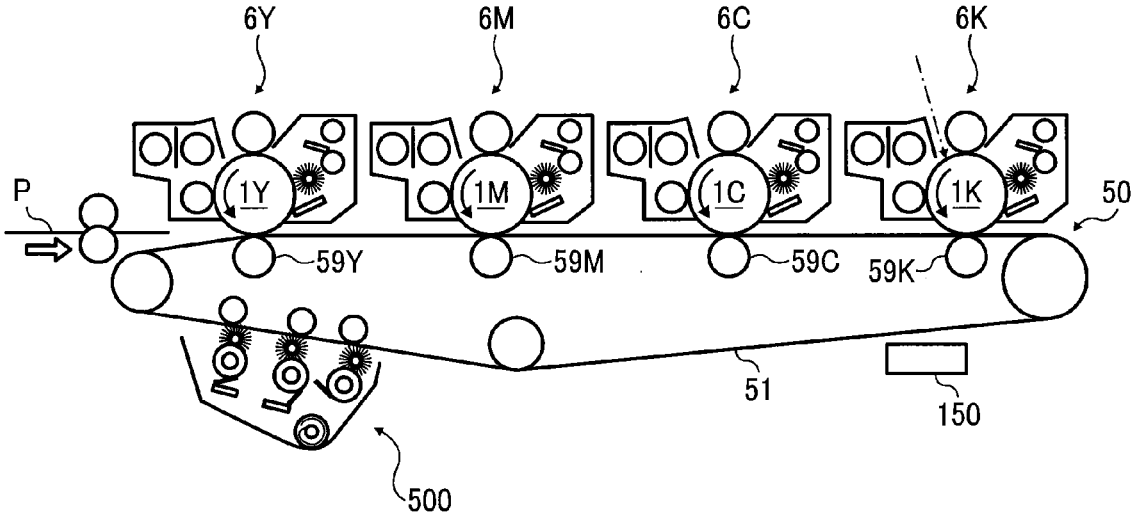
FIG. 15 is a schematic of a relevant portion of a tandem direct transfer printer.

The cleaning device of an embodiment of the present invention is applicable not only to the belt cleaning device 100 that cleans the front surface of the intermediate transfer belt but also to a cleaning device 500 including a paper conveying belt 51 as illustrated in FIG. 15. As illustrated in FIG. 15, the paper conveying belt 51 as a body to be cleaned that is used in a tandem direct transfer image forming apparatus comes in contact with the photosensitive elements 1Y, M, C, and K to form primary transfer nips for Y, M, C, and K. The paper conveying belt 51 retains the recording sheet P on its surface and feeds it from left to right as viewed in FIG. 15 while following its endless movement. In this process, the recording sheet P is sequentially fed into the primary transfer nips for Y, M, C, and K. Thus, Y, M, C, and K toner images are superimposed to be primary transferred onto the recording sheet P. The conveying belt cleaning device 500 removes stains of toner or the like that adhere to the paper conveying belt 51 after the belt has passed through the primary transfer nip for K. The optical sensor unit 150 is provided so as to oppose the front surface of the paper conveying belt 51 in a predetermined space. The printer illustrated in FIG. 15 also performs image density control and positional deviation amount correction control at a predetermined timing. In the printer, predetermined toner patterns (tone patterns and chevron patches) are formed on the paper conveying belt 51, the optical sensor unit 150 detects the toner patterns, and a predetermined correction process is performed based on the detected result. The conveying belt cleaning device 500 removes the toner patterns that are untransferred toner images detected by the optical sensor unit 150. As described above, the paper conveying belt 51 functions as an image carrier that carries toner images.

The cleaning device of an embodiment of the preset invention is applied to the conveying belt cleaning device 500, and thus, the toner patterns formed on the paper conveying belt 51 can be favorably removed to inhibit the back surface of the recording sheet from being stained with the toner or the like.

Figure 16:
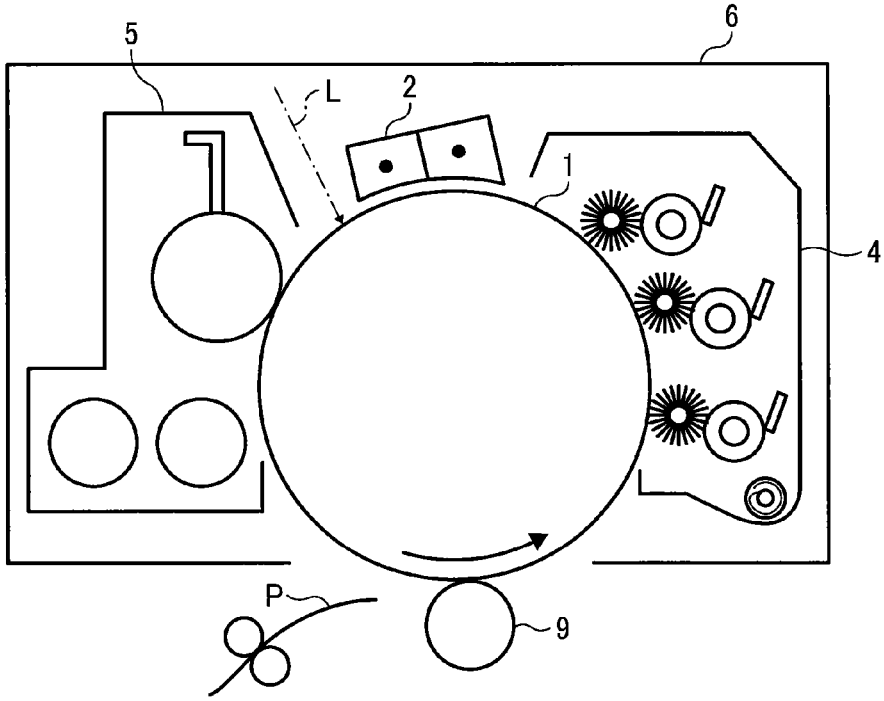
FIG. 16 is a schematic of a relevant portion of a monochrome printer.

As illustrated in FIG. 16, the cleaning device of an embodiment of the present invention is also applicable to the drum cleaning device 4. Toner consumption patterns produced when a refreshing mode for refreshing the inside of the developing unit and untransferred toner images such as toner images on the photosensitive element produced when a paper jam occurs enter the drum cleaning device 4. The untransferred toner images entering the drum cleaning device 4 can be favorably removed by applying the cleaning device of an embodiment of the present invention to the drum cleaning device 4.

The belt cleaning device 100 as the cleaning device of the embodiment described above includes the normally charged toner cleaning unit 100*c* including: the normally charged toner cleaning brush roller 107 serving as a normally charged toner cleaning member that is applied with a voltage having a reversed polarity relative to the normally charged polarity of the toner, and electrostatically removes the toner having the normally charged polarity on the intermediate transfer belt 8 as a body to be cleaned; the normally charged toner recovery roller 108 serving as a normally charged toner recovery member that can make the toner on the normally charged toner cleaning brush roller 107 electrostatically move to the surface itself and recover the toner; and the normally charged toner scraping blade 109 serving as a normally charged toner scraping member that rubs the surface of the normally charged toner recovery roller 108 and scrapes off the toner on the normally charged toner recovery roller 108. The belt cleaning device 100 also includes the reversely charged toner cleaning unit 100*b* including: the reversely charged toner cleaning brush roller 104 serving as a reversely charged toner cleaning member that makes contact with the intermediate transfer belt 8 while rotating, is applied with a voltage having a polarity same as the normally charged polarity of the toner, and electrostatically removes the toner having a reversed polarity relative to the normally charged polarity on the body to be cleaned; the reversely charged toner recovery roller 105 serving as a reversely charged toner recovery member that can make the toner on the reversely charged toner cleaning brush roller 104 electrostatically move to the surface itself and recover the toner; and the reversely charged toner scraping blade 106 serving as a reversely charged toner scraping member that rubs the surface of the reversely charged toner recovery roller 105 and scrapes off the toner on the reversely charged toner recovery roller 105. The belt cleaning device 100 also includes the pre-cleaning unit including: the pre-cleaning brush roller 101 serving as a pre-cleaning member that is arranged upstream of the normally charged toner cleaning brush roller 107 and the reversely charged toner cleaning brush roller 104 in the movement direction of the surface of the intermediate transfer belt 8, makes contact with the intermediate transfer belt 8 while rotating, is applied with a voltage having a reversed polarity relative to the normally charged polarity of the toner, and electrostatically removes the toner having the normally charged polarity; the pre-recovery roller 102 serving as a pre-recovery member that can make the toner on the pre-cleaning brush roller 101 electrostatically move to the surface itself and recover the toner; and the pre-scraping blade 103 serving as a pre-scraping member that rubs the surface of the pre-recovery roller 102 and scrapes off the toner on the pre-recovery roller 102.

With such a structure, when the untransferred toner images containing a large amount of the toner charged to the normally charged polarity enters the belt cleaning device 100, the pre-cleaning brush roller 101 can roughly remove the toner charged to the normally charged polarity of the untransferred toner images. This reduces the toner amount entering the normally charged toner cleaning brush roller 107 and the reversely charged toner cleaning brush roller 104 that are arranged downstream of the pre-cleaning brush roller 101 in the belt movement direction. Thus, the normally charged toner cleaning brush roller 107 can favorably remove the toner charged to the normally charged polarity that cannot be removed by the pre-cleaning brush roller 101. The reversely charged toner cleaning brush roller 104 can favorably remove the toner charged to a reversed polarity relative to the normally charged polarity. Accordingly, even when the untransferred toner images enter the belt cleaning device, the untransferred toner images can be favorably removed from the intermediate transfer belt.

A cleaning device includes a cleaning unit including: a polarity control unit that controls the charged polarity of the toner on the intermediate transfer belt 8 as a body to be cleaned; a cleaning brush roller as a cleaning member that is arranged downstream of the polarity control unit in the movement direction of the surface of the intermediate transfer belt 8, is applied with a voltage having a reversed polarity relative to the charged polarity of the toner controlled by the polarity control unit, and electrostatically removes the toner; a recovery roller as a recovery member that can make the toner on the cleaning brush roller electrostatically move to the surface itself and recover the toner; and a scraping blade as a scraping member that rubs the surface of the recovery roller and scrapes off the toner on the recovery roller. With the structure, even when the cleaning device includes the pre-cleaning unit as mentioned above at the upstream of the polarity control unit in the movement direction of the intermediate transfer belt 8, effects similar to the effects described above can be obtained. In other words, when the untransferred toner images containing a large amount of the toner charged to the normally charged polarity enters the belt cleaning device 100, the pre-cleaning brush roller 101 can roughly remove the toner charged to the normally charged polarity of the untransferred toner images. This reduces the toner amount entering the polarity control unit arranged downstream of the pre-cleaning brush roller 101 in the belt movement direction. As a result, the polarity control unit can favorably control the charged polarity of the toner on the intermediate transfer belt 8. Thus, the polarity control unit can align the charged polarity of the toner entering the cleaning brush roller arranged downstream of the polarity control unit in the belt movement direction. The toner amount entering the cleaning brush roller is small, and thus, the cleaning brush roller can favorably remove the toner on the intermediate transfer belt that cannot be removed by the pre-cleaning brush roller. As a result, even when the untransferred toner images enter the belt cleaning device, the untransferred toner images can be favorably removed from the intermediate transfer belt.

In the cleaning device, the linear pressure of the scraping blade against the recovery roller of the cleaning unit provided downstream of the pre-cleaning unit in the movement direction of the intermediate transfer belt is set to be smaller than the linear pressure of the pre-scraping blade against the pre-recovery roller. This structure can reduce the following shortcomings as compared with the structure in which the linear pressure of the scraping blade against the recovery roller of the cleaning unit provided downstream of the pre-cleaning unit in the movement direction of the intermediate transfer belt is set to be the same as the linear pressure of the pre-scraping blade against the pre-recovery roller. The shortcomings that can be reduced are: the abrasion of the scraping blade of the cleaning unit provided downstream of the pre-cleaning unit in the movement direction of the intermediate transfer belt, the torque increase of the recovery roller of the cleaning unit provided downstream of the pre-cleaning unit in the movement direction of the intermediate transfer belt, and the fixing of the toner to the scraping blade of the cleaning unit provided downstream of the pre-cleaning unit in the movement direction of the intermediate transfer belt. As a result, the cleaning ability of the cleaning unit provided downstream of the pre-cleaning unit in the movement direction of the intermediate transfer belt can be maintained over time.

The reversely charged toner cleaning brush roller 104 arranged upstream in the movement direction of the surface of the intermediate transfer belt 8 out of the reversely charged toner cleaning brush roller 104 and the normally charged toner cleaning brush roller 107 electrostatically removes the toner while injecting charges having the same polarity as the normally charged polarity into the toner on the intermediate transfer belt 8. Thus, the polarity of the toner on the intermediate transfer belt 8 entering the normally charged toner cleaning brush roller 107 can be aligned with the normally charged polarity. Accordingly, the toner on the intermediate transfer belt 8 passing through the reversely charged toner cleaning brush roller can be reliably electrostatically adsorbed to the normally charged toner cleaning brush roller 107 to be removed.

As described above, the reversely charged toner cleaning brush roller 104 arranged upstream in the movement direction of the surface of the intermediate transfer belt 8 out of the reversely charged toner cleaning brush roller 104 and the normally charged toner cleaning brush roller 107 injects charges having the same polarity as the normally charged polarity into the toner on the intermediate transfer belt 8. With this structure, the linear pressure of the reversely charged toner scraping blade 106 against the reversely charged toner recovery roller 105 is set to be smaller than the linear pressure of the normally charged toner scraping blade 109 against the normally charged toner recovery roller 108. This structure can reduce the following shortcomings as compared with the structure in which the linear pressure of the reversely charged toner scraping blade 106 against the reversely charged toner recovery roller 105 is set to be the same as the linear pressure of the normally charged toner scraping blade 109 against the normally charged toner recovery roller 108. The shortcomings can be reduced are: the abrasion of the reversely charged toner scraping blade, the torque increase of the reversely charged toner recovery roller, and the fixing of the toner to the reversely charged toner scraping blade.

The surface roughness Ra of the recovery roller of the cleaning unit provided downstream of the pre-cleaning unit in the movement direction of the intermediate transfer belt may be set to be smaller than the surface roughness Ra of the pre-recovery roller. With this structure, the friction between the scraping blade and the recovery roller can be inhibited as compared with the structure in which the surface roughness Ra of the recovery roller of the cleaning unit provided downstream of the pre-cleaning unit in the movement direction of the intermediate transfer belt is set to be the same as the surface roughness Ra of the pre-recovery roller. This structure can inhibit the abrasion of the scraping blade of the cleaning unit provided downstream of the pre-cleaning unit in the movement direction of the intermediate transfer belt, the torque increase of the recovery roller of the cleaning unit provided downstream of the pre-cleaning unit in the movement direction of the intermediate transfer belt, and the fixing of the toner to the scraping blade of the cleaning unit provided downstream of the pre-cleaning unit in the movement direction of the intermediate transfer belt. Thus, the cleaning ability of the cleaning unit provided downstream of the pre-cleaning unit in the movement direction of the intermediate transfer belt can be maintained over time.

The reversely charged toner cleaning brush roller 104 arranged upstream in the movement direction of the surface of the intermediate transfer belt 8 out of the reversely charged toner cleaning brush roller 104 and the normally charged toner cleaning brush roller 107 injects charges having the same polarity as the normally charged polarity into the toner on the intermediate transfer belt 8. With this structure, the surface roughness Ra of the reversely charged toner recovery roller 105 is set to be smaller than the surface roughness Ra of the normally charged toner recovery roller 108. This structure can inhibit the abrasion of the reversely charged toner scraping blade, the torque increase of the reversely charged toner recovery roller, and the fixing of the toner to the reversely charged toner scraping blade as compared with the structure in which the surface roughness Ra of the reversely charged toner recovery roller 105 is set to be the same as the surface roughness Ra of the normally charged toner recovery roller 108.

An image forming apparatus forms images on a recording sheet as a recording member by eventually transferring a toner image formed on the image carrier from the image carrier onto the recording member. In the image forming apparatus, the cleaning device as described above is used as a cleaning device for cleaning the toner left untransferred remaining on the image carrier after the transfer and thus can favorably remove the toner on the image carrier. In such a manner, images with high quality can be obtained.

The cleaning device of an embodiment of the present invention is used as the belt cleaning device 100 for cleaning the intermediate transfer belt 8 serving as an image carrier and thus can favorably remove the toner on the intermediate transfer belt 8. In such a manner, the toner on the intermediate transfer belt 8 can be favorably removed, and thus, images with high quality can be obtained.

As illustrated in FIG. 15, the cleaning device of an embodiment of the present invention is used as the conveying belt cleaning device 500 for removing the toner remaining on the conveying belt that conveys a recording sheet and thus can favorably remove the toner on the paper conveying belt 51. In such a manner, the back surface of the recording sheet can be inhibited from being stained with the toner.

According to the present invention, when an untransferred toner image enters the cleaning device, the pre-cleaning member roughly removes the toner having the normally charged polarity that is dominant in the toner constituting the untransferred toner image. Therefore, the toner amount entering the normally charged toner cleaning member and the reversely charged toner cleaning member decreases. While the normally charged toner cleaning member electrostatically removes the remaining normally charged toner that cannot be removed by the pre-cleaning member, the reversely charged toner cleaning member electrostatically removes the toner having a reversed polarity relative to the normally charged polarity. Thus, even when the untransferred toner image enters the cleaning device, the image can be favorably removed.

According to the present invention, when an untransferred toner image enters the cleaning device, the pre-cleaning member roughly removes the toner having the normally charged polarity that is dominant in the toner constituting the untransferred toner image. Therefore, the amount of the toner on a body to be cleaned that enters the polarity control unit decreases, and as a result, a charged polarity unit can favorably control the toner on the body to be cleaned passing through the pre-cleaning member to have one of the polarities. Thus, the charged polarity of the toner entering the cleaning member is aligned with one of the polarities, and the toner amount is small. Therefore, the cleaning member can favorably remove the toner on the body to be cleaned that cannot be removed by the pre-cleaning member. As a result, even when the untransferred toner image enters the cleaning device, the image can be favorably removed.

The toner can be inhibited from being fixed to the scraping member of the cleaning unit provided downstream of the pre-cleaning unit in the movement direction of the body to be cleaned by including at least any one of the following two structures.

1. The linear pressure of the scraping member against the recovery member of the cleaning unit provided downstream of the pre-cleaning unit in the movement direction of the body to be cleaned is set to be smaller than the linear pressure of the pre-scraping member against the pre-recovery member.
2. The surface roughness of the recovery member of the cleaning unit provided downstream of the pre-cleaning unit in the movement direction of the body to be cleaned is set to be smaller than the surface roughness of the pre-recovery member.

The present invention includes the structure 1. This structure can suppress heat generation due to the friction between the scraping member and the recovery member of the cleaning unit provided downstream in the movement direction of the body to be cleaned as compared with the case in which the linear pressure of the scraping member against the recovery member of the cleaning unit at the downstream is set to be the same as the linear pressure of the pre-scraping member against the pre-recovery member. Therefore, the toner entering the contact portion between the scraping member and the recovery member of the cleaning unit provided downstream in the movement direction of the body to be cleaned can be inhibited from melting, and thus can be inhibited from being fixed to the scraping member. When the linear pressure of the scraping member against the recovery member is set to be small, the scraping ability of the scraping member decreases. However, in the present invention as mentioned above, the pre-cleaning unit removes the toner on the body to be cleaned, and therefore, the amount of the toner to be removed by the cleaning unit provided downstream of the pre-cleaning unit in the movement direction of the body to be cleaned is small. Accordingly, the amount of the toner to be scraped by the scraping member of the cleaning unit provided downstream of the pre-cleaning unit in the movement direction of the body to be cleaned is small, and thus, even when the linear pressure is set to be small, the toner on the surface of the recovery member can be favorably scraped off.

In contrast, the pre-cleaning unit removes a large amount of the toner, and thus, a large amount of the toner enters the contact portion between the pre-scraping member and the pre-recovery member. However, the linear pressure of the pre-scraping member against the pre-recovery member is large. Therefore, even when a large amount of the toner enters the contact portion between the pre-scraping member and the pre-recovery member, the pre-scraping member can favorably scrape off the toner on the surface of the pre-recovery member. A large amount of the toner enters the contact portion between the pre-scraping member and the pre-recovery member, and therefore, the toner entering the contact portion between the pre-scraping member and the pre-recovery member can sufficiently have an effect as a lubricant. As a result, even when the linear pressure of the pre-scraping member against the pre-recovery member is set to be large, the friction between the pre-scraping member and the pre-recovery member can be inhibited to suppress the heat generation of the pre-scraping member. Accordingly, even when the linear pressure of the pre-scraping member against the pre-recovery member is set to be large, the toner can be inhibited from being fixed to the pre-scraping member.

The present invention includes the structure 2. This structure can suppress the heat generation due to the friction between the scraping member and the recovery member of the cleaning unit provided downstream in the movement direction of the body to be cleaned as compared with the case in which the surface roughness of the recovery member of the cleaning unit at the downstream is set to be the same as the surface roughness of the pre-recovery member. Therefore, the toner entering the contact portion between the scraping member and the recovery member of the cleaning unit provided downstream in the movement direction of the body to be cleaned can be inhibited from melting, and thus can be inhibited from being fixed to the scraping member. The toner adhering to the cleaning member becomes less likely to be caught in the surface of the recovery member by reducing the surface roughness of the recovery member to reduce the toner recovery ability of the recovery member. However, in the present invention as mentioned above, the pre-cleaning unit removes the toner on the body to be cleaned, and therefore, the amount of the toner to be removed by the cleaning unit provided downstream of the pre-cleaning unit in the movement direction of the body to be cleaned is small. Accordingly, even when the surface roughness of the recovery member is set to be small, the toner can be favorably recovered from the cleaning member.

In contrast, the pre-cleaning unit removes a large amount of the toner, and thus, the pre-recovery member recovers a large amount of the toner. However, the toner adhering to a pre-cleaning brush is easily caught in the surface of the pre-recovery member because the surface roughness of the pre-recovery member is set to be large, and therefore, the pre-recovery member has high toner recovery ability. Accordingly, even when a large amount of the toner adheres to the pre-cleaning member, the pre-recovery member can favorably recover the toner. The surface roughness of the pre-recovery member is large, and therefore, the pre-scraping member easily generates heat due to the friction with the pre-recovery member. However, a large amount of the toner enters the contact portion between the pre-recovery member and the pre-scraping member, and therefore, the toner entering the contact portion between the pre-scraping member and the pre-recovery member can sufficiently have an effect as a lubricant. As a result, even when the surface roughness of the pre-recovery member is set to be large, the friction between the pre-recovery member and the pre-scraping member can be inhibited to suppress the heat generation of the pre-scraping member. Accordingly, even when the linear pressure of the pre-scraping member against the pre-recovery member is set to be large, the toner can be inhibited from being fixed to the pre-scraping member.

According to the present invention, untransferred toner images and toners left untransferred can be favorably removed from the body to be cleaned, and the toners can be inhibited from being fixed to the scraping blade of the cleaning unit provided downstream of the pre-cleaning unit in a movement direction of the body to be cleaned.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device comprising:

a normally charged toner cleaning unit including a normally charged toner cleaning member that is applied with a voltage having a reversed polarity relative to a normally charged polarity of a toner and electrostatically removes the toner having the normally charged polarity on a body to be cleaned, a normally charged toner recovery member that makes the toner on the normally charged toner cleaning member electrostatically move to a surface of the normally charged toner recovery member and recovers the toner, and a normally charged toner scraping member that rubs the surface of the normally charged toner recovery member and scrapes off the toner on the normally charged toner recovery member;

a reversely charged toner cleaning unit including a reversely charged toner cleaning member that makes contact with the body to be cleaned while rotating, is applied with a voltage having a polarity same as the normally charged polarity of the toner, and electrostatically removes the toner having a reversed polarity relative to the normally charged polarity on the body to be cleaned, a reversely charged toner recovery member that makes the toner on the reversely charged toner cleaning member electrostatically move to a surface of the reversely charged toner recovery member and recovers the toner, and a reversely charged toner scraping member that rubs the surface of the reversely charged toner recovery member and scrapes off the toner on the reversely charged toner recovery member; and a pre-cleaning unit including a pre-cleaning member that is arranged upstream of the normally charged toner cleaning member and the reversely charged toner cleaning member in a movement direction of a surface of the body to be cleaned, makes contact with the body to be cleaned while rotating, is applied with a voltage having a reversed polarity relative to the normally charged polarity of the toner, and electrostatically removes the toner having the normally charged polarity, a pre-recovery member that makes the toner on the pre-cleaning member electrostatically move to a surface of the pre-recovery member and recovers the toner, and a pre-scraping member that rubs the surface of the pre-recovery member and scrapes off the toner on the pre-recovery member, wherein a toner recovery ability of the normally charged toner scraping member from the normally charged toner recovery member and a toner recovery ability of the reversely charged toner scraping member from the reversely charged toner recovery member are set to be smaller than a toner recovery ability of the pre-scraping member from the pre-recovery member.

2. The cleaning device according to claim 1, wherein a linear pressure of the normally charged toner scraping member against the normally charged toner recovery member and a linear pressure of the reversely charged toner scraping member against the reversely charged toner recovery member are set to be smaller than a linear pressure of the pre-scraping member against the pre-recovery member to represent the toner recovery abilities.

3. The cleaning device according to claim 1, wherein an upstream cleaning unit arranged upstream in the movement direction of the surface of the body to be cleaned out of the reversely charged toner cleaning unit and the normally charged toner cleaning unit electrostatically removes the toner on the body to be cleaned while injecting charges having a same polarity as a polarity of a voltage applied to the cleaning member of the cleaning unit into the toner, and wherein a linear pressure of the scraping member against the recovery member of the upstream cleaning unit is set to be smaller than a linear pressure of the scraping member against the recovery member of a downstream cleaning unit arranged downstream in the movement direction of the surface of the body to be cleaned out of the reversely charged toner cleaning unit and the normally charged toner cleaning unit.

4. The cleaning device according to claim 1, wherein a surface roughness of the normally charged toner recovery member and a surface roughness of the reversely charged toner recovery member are set to be smaller than a surface roughness of the pre-recovery member to represent the toner recovery abilities.

5. The cleaning device according to claim 1, wherein an upstream cleaning unit arranged upstream in the movement direction of the surface of the body to be cleaned out of the reversely charged toner cleaning unit and the normally charged toner cleaning unit electrostatically removes the toner on the body to be cleaned while injecting charges having a same polarity as a polarity of a voltage applied to the cleaning member of the cleaning unit into the toner, and wherein a surface roughness of the recovery member of the upstream cleaning unit is set to be smaller than a surface roughness of the recovery member of a downstream cleaning unit arranged downstream in the movement direction of the surface of the body to be cleaned out of the reversely charged toner cleaning unit and the normally charged toner cleaning unit.

6. The cleaning device according to claim 1, wherein the recovery member and the scraping member of each of the cleaning units are made of stainless steel.

7. An image forming apparatus that forms an image on a recording member by eventually transferring a toner image formed on an image carrier from the image carrier to the recording member, wherein the cleaning device according to claim 1 is used as a cleaning device for cleaning a toner left untransferred remaining on the image carrier after the transferring.

8. A cleaning device comprising:

a polarity control unit that controls a charged polarity of a toner on a body to be cleaned;

a cleaning unit including a cleaning member that is arranged downstream of the polarity control unit in a movement direction of a surface of the body to be cleaned, is applied with a voltage having a reversed polarity relative to a charged polarity of the toner controlled by the polarity control unit, and electrostatically removes the toner, a recovery member that makes the toner on the cleaning member electrostatically move to a surface of the recovery member and recovers the toner, and a scraping member that rubs the surface of the recovery member and scrapes off the toner on the recovery member; and a pre-cleaning unit including a pre-cleaning member that is arranged upstream of the polarity control unit in the movement direction of the surface of the body to be cleaned, is applied with a voltage having a reversed polarity relative to a normally charged polarity of the toner, and electrostatically removes the toner having the normally charged polarity, a pre-recovery member that makes the toner on the pre-cleaning member electrostatically move to a surface of the pre-recovery member and recovers the toner, and a pre-scraping member that rubs the surface of the pre-recovery member and scrapes off the toner on the pre-recovery member, wherein a toner recovery ability of the scraping member from the recovery member is set to be smaller than a toner recovery ability of the pre-scraping member from the pre-recovery member.

9. The cleaning device according to claim 8, wherein a linear pressure of the scraping member against the recovery member is set to be smaller than a linear pressure of the pre-scraping member against the pre-recovery member to represent the toner recovery abilities.

10. The cleaning device according to claim 8, wherein a surface roughness of the recovery member is set to be smaller than a surface roughness of the pre-recovery member to represent the toner recovery abilities.

11. The cleaning device according to claim 8, wherein the recovery member and the scraping member of each of the cleaning units are made of stainless steel.

12. An image forming apparatus that forms an image on a recording member by eventually transferring a toner image formed on an image carrier from the image carrier to the recording member, wherein the cleaning device according to claim 8 is used as a cleaning device for cleaning a toner left untransferred remaining on the image carrier after the transferring.

* * * * *